US010280723B2

(12) United States Patent
Ageev et al.

(10) Patent No.: US 10,280,723 B2
(45) Date of Patent: May 7, 2019

(54) PLASMA SOURCE FOR GENERATING NONLINEAR, WIDE-BAND, PERIODIC, DIRECTED, ELASTIC OSCILLATIONS AND A SYSTEM AND METHOD FOR STIMULATING WELLS, DEPOSITS AND BOREHOLES USING THE PLASMA SOURCE

(71) Applicant: Novas Energy Group Limited, Tortola (VG)

(72) Inventors: P. G. Ageev, Moscow (RU); A. A. Molchanov, Saint Petersburg (RU)

(73) Assignee: NOVAS ENERGY GROUP LIMITED, Road Town, Tortola (VG)

( * ) Notice: Subject to any disclaimer, the term of this patent is extended or adjusted under 35 U.S.C. 154(b) by 0 days.

(21) Appl. No.: 15/243,932

(22) Filed: Aug. 22, 2016

(65) Prior Publication Data

US 2017/0167215 A1 Jun. 15, 2017

Related U.S. Application Data

(63) Continuation of application No. 14/934,564, filed on Nov. 6, 2015, now Pat. No. 9,422,799, which is a (Continued)

(51) Int. Cl.
*E21B 43/25* (2006.01)
*H05H 1/24* (2006.01)

(Continued)

(52) U.S. Cl.
CPC ..... *E21B 43/25* (2013.01); *E21B 28/00* (2013.01); *E21B 43/003* (2013.01); *E21B 43/24* (2013.01);

(Continued)

(58) Field of Classification Search
CPC ..... E21B 43/00; E21B 28/00; E21B 43/003; E21B 43/16; E21B 43/2401; E21B 43/2405; E21B 43/25; E21B 43/263
See application file for complete search history.

(56) References Cited

U.S. PATENT DOCUMENTS 4,345,650 A * 8/1982 Wesley ..... E21B 36/04 166/177.2
5,004,050 A * 4/1991 Sizonenko ..... E21B 43/003 166/248

(Continued)

FOREIGN PATENT DOCUMENTS

CN 2271610 12/1997
RU 2248591 3/2005

(Continued)

OTHER PUBLICATIONS

Search Report and Written Opinion for PCT/US2013/052295, dated Aug. 27, 2014.

(Continued)

*Primary Examiner* — Nicole Coy
*Assistant Examiner* — Tara E Schimpf
(74) *Attorney, Agent, or Firm* — Bryan Cave Leighton Paisner LLP

(57) ABSTRACT

In some embodiments, a plasma source can comprise a plasma emitter comprising a first electrode and a second electrode, the first electrode and the second electrode defining an electrode gap. In some embodiments, the plasma source can further comprise an enclosure housing attached to a distal end of the plasma emitter, the enclosure housing can comprise a delivery device configured to introduce a metal conductor through an axial opening in the second electrode and into the electrode gap and a device housing attached to a proximal end of the plasma emitter, the device housing can comprise a high voltage transformer electrically (Continued)

coupled to a capacitor unit. In some embodiments, the capacitor unit electrically can be coupled to a contactor, and the contactor can be electrically coupled to the first electrode. Other embodiments of related methods and systems are also provided.

20 Claims, 9 Drawing Sheets

Related U.S. Application Data continuation of application No. 13/951,020, filed on Jul. 25, 2013, now Pat. No. 9,181,788.

(60) Provisional application No. 61/684,988, filed on Aug. 20, 2012, provisional application No. 61/676,411, filed on Jul. 27, 2012.

(51) Int. Cl.

| | |
|---|---|
| ***E21B 43/00*** | (2006.01) |
| ***H05H 1/52*** | (2006.01) |
| ***E21B 28/00*** | (2006.01) |
| ***E21B 43/24*** | (2006.01) |
| ***E21B 43/26*** | (2006.01) |
| *E21B 43/11* | (2006.01) |
| *E21B 47/00* | (2012.01) |

(52) U.S. Cl.

CPC ..... *E21B 43/26* (2013.01); *H05H 1/24* (2013.01); *H05H 1/52* (2013.01); *E21B 43/11* (2013.01); *E21B 47/00* (2013.01)

(56) References Cited

U.S. PATENT DOCUMENTS

| | | | | |
|---|---|---|---|---|
| 5,301,169 | A * | 4/1994 | Baria | G01V 1/157 181/106 |
| 5,397,961 | A | 3/1995 | Ayers et al. | |
| 5,416,391 | A | 5/1995 | Correa et al. | |
| 5,425,570 | A | 6/1995 | Wilkinson | |
| 5,573,307 | A | 11/1996 | Wilkinson et al. | |
| 6,227,293 | B1 | 5/2001 | Huffman et al. | |
| 6,427,774 | B2 | 8/2002 | Thomas et al. | |
| 6,499,536 | B1 | 12/2002 | Ellingsen | |
| 6,597,632 | B2 | 7/2003 | Khan | |
| 7,562,740 | B2 | 7/2009 | Ounadjela | |
| 7,849,919 | B2 | 12/2010 | Wood et al. | |
| 9,181,788 | B2 | 11/2015 | Ageev et al. | |
| 9,422,799 | B2 | 8/2016 | Ageev et al. | |
| 2001/0011590 | A1 * | 8/2001 | Thomas | E21B 28/00 166/248 |
| 2005/0016965 | A1 * | 1/2005 | Miyake | B23H 7/26 219/69.2 |
| 2005/0194093 | A1 | 9/2005 | Makino et al. | |
| 2009/0294121 | A1 * | 12/2009 | Leon | E21B 43/26 166/248 |
| 2010/0206554 | A1 * | 8/2010 | Neuhaus | E21B 4/04 166/244.1 |
| 2011/0139440 | A1 | 6/2011 | Zolezzi-Garreton | |
| 2011/0139441 | A1 | 6/2011 | Zolezzi Garreton | |
| 2012/0043075 | A1 | 2/2012 | Abramova et al. | |
| 2014/0027110 | A1 | 1/2014 | Ageev et al. | |
| 2016/0060987 | A1 | 3/2016 | Ageev et al. | |

FOREIGN PATENT DOCUMENTS

| | | | | |
|---|---|---|---|---|
| RU | 2373387 | C1 * | 11/2009 | |
| WO | WO-2004061257 | A2 * | 7/2004 | G01V 1/157 |
| WO | 2014018868 | | 1/2014 | |

OTHER PUBLICATIONS

European Search Report for European Application No. 13822820.0, dated Jun. 20, 2016.

Champion, B, et al., "The Application of High-Power Sound Waves for Weelbore Cleaning," SPE Production and Facilities, Society of Petroleum Engineers, Richardson, TX, US, No. SPE 82197, Aug. 2004, pp. 113-121, KP002636520, ISSN: 1064-668X, figures 3-6, p. 1.

* cited by examiner

*The Effect of Nonlinear Plasma Treatment on Vertical Well Production*

*Polar Light Company (OJSC Rosneft-ConacoPhillips)*

| Field | Well | Reservoir | Perforation interval, m | Before treatment | | | | Estimates | | | | After treatment | | | | Treatment efficiency | | |
|---|---|---|---|---|---|---|---|---|---|---|---|---|---|---|---|---|---|---|
| | | | | Qfuid, m³/day | Qoil, t /day | Wat., % | FBHP, m/atm | Qfuid, m³/day | Qoil, t /day | Wat., % | FBHP, m/atm | Qfuid, m³/day | Qoil, t /day | Wat., % | FBHP, m/atm | Qfuid, m³/day | Qoil, t /day | Wat., % |
| Ardalin | 5 | D3-fm | Open hole with diameter 171 mm in the interval of 3506-3616 m: productive interval: 3605.8-3616.2 m | 382 | 45 | 86 | 1670/ 187 | 400 | 54 | 80-86 | 1670/ 187 | 393 | 62 | 79 | 1648/ 167 | +11 | +17 | < 7 |
| Dusushev | 7 | D3-fm | 3565.0-3568.0<br>3577.0-3583.0<br>3588.0-3591.0 | 14 | 1.8 | 85 | 2250/ 161 | 30 | 3,8 | 85 | 2000/ 178 | 43 | 11.2 | 70.2 | 1817/ 192 | +29 | +9.4 | <14.8 |
| Oshkotyn | 44 | D3-fm | 3220.0-3224.0 | 53 | 22 | 50 | 1706 | 70 | 32 | 46 | 2110 | 107.8 | 29.5 | 67.7 | 1189 | +54.8 | +7.5 | >17.6 |
| Dusushev | 160 | D3-fm | 3309.0-3333.0 | 315 | 44 | 84 | 480/ 265 | 324 | 51 | 82 | 330/ 274 | 325 | 48 | 83,8 | 535/ 261 | +10 | +4 | < 0.2 |
| West Sikhorey | 70 | D3-fm | 3300.0-3370.0 (open hole) | 105 | 85 | 6.5 | 2245 | 114 | 93 | 6.5 | 2100 | 211 | 165 | 10 | 1374 | +107 | +80 | > 3.5 |

FIG. 8

OJSC Udmurtneft (Rosneft-Cinoped Corp.)

| Field | Well | Reservoir rock | Goal | Before treatment | | Estimates | | After treatment | | Treatment efficiency |
|---|---|---|---|---|---|---|---|---|---|---|
| | | | | Qfuid, m³/day | Pwat, atm | Qfuid, m³/day | Pwat,atm | Qfuid, m³/day | Pwat,atm | Qfuid, m³/day |
| Izhevsk | 2822 | Carb. | Increase in injection capacity (without tubing removal) | 6.47 | 95 | 27 | 95 | 9.39 | 95 | 2.92 |
| Izhevsk | 2858 | Carb. | Increase in injection capacity (without tubing removal) | 6 | 107 | 25 | 107 | 17.3 | 107 | 11.3 |

Nord Imperial (ONGC)

| Field | Well | Reservoir rock | Goal | Before treatment | | | Estimates | | After treatment | | | Treatment efficiency |
|---|---|---|---|---|---|---|---|---|---|---|---|---|
| | | | | Qfuid, m³/day | Pwat, atm | Conformance factor | Qfuid, m³/day | Pwat,atm | Qxk, M³/day | Pu, aTM | Conformance factor | Pwat,atm |
| May | 215 | Sand Stone | Increase in injection capacity of unbroken stratum separate interval | 0 | 195 | 0.2 | 30 | 195 | 15.9 | 191 | 0.54 | 15.9 |
| May | 211 | Sand Stone | Increase in injection capacity of unbroken stratum separate interval | 34 | 192 | 0.7 | 55 | 192 | 43.2 | 180 | 0.75 | 9.2 |

FIG. 9

PLASMA SOURCE FOR GENERATING NONLINEAR, WIDE-BAND, PERIODIC, DIRECTED, ELASTIC OSCILLATIONS AND A SYSTEM AND METHOD FOR STIMULATING WELLS, DEPOSITS AND BOREHOLES USING THE PLASMA SOURCE

CROSS-REFERENCE TO RELATED APPLICATIONS

The present application claims priority to and is a continuation of U.S. patent application Ser. No. 14/934,564, entitled "Plasma Source for Generating Nonlinear, Wide-Band, Periodic, Directed, Elastic Oscillations and a System and Method for Stimulating Wells, Deposits and Boreholes Using the Plasma Source," filed on Nov. 6, 2015, which is a continuation of U.S. patent application Ser. No. 13/951,020, entitled "Plasma Source for Generating Nonlinear, Wide-Band, Periodic, Directed, Elastic Oscillations and a System and Method for Stimulating Wells, Deposits and Boreholes Using the Plasma Source," filed on Jul. 25, 2013, which claims priority to U.S. Provisional Patent Application 61/684,988, entitled "Process and Apparatus for the Production Enhancement of Hydrocarbon Deposits Using Metallic Plasma-Generated, Directed, Nonlinear, Wide-Band and Elastic Oscillations at Resonance Frequencies," filed on Aug. 20, 2012, and claims priority to U.S. Provisional Patent Application 61/676,411, entitled, "Ideal Non-Linear Wide-Band Well Source of Periodic Directed Elastic Fluctuations, Equipped with a Metallic Plasma Creation Device to Stimulate Hydrocarbon Productive Deposit at Resonance Frequencies," filed Jul. 27, 2012, all of which are hereby incorporated by reference.

BACKGROUND

The invention is intended for use in the oil and gas industry, and generally relates to methods and devices that are utilized for stimulating hydrocarbon wells and deposits. More particularly, the invention relates to such methods and device that use metallic plasma-generated, directed nonlinear, wide band and elastic or controlled periodic oscillations at resonance frequencies, and uses the energy released upon plasma formation to quickly alter productivity of said wells and deposits.

The invention further relates to modifying the capacity of such wells, including boreholes and openings, that are production, injection, mature, depleted, waste disposal, conservation, land, on-shore or off-shore. The wells may be oriented at any angle with respect to the earth's surface without horizontal completion. The invention utilizes plasma energy to improve the permeability of said wells and their surrounding matter, optimize the viscosity and/or other physical characteristics of fluids and media, and obtain the enhanced recovery of hydrocarbons and an enhanced intake. In particular, the invention relates to the methods of secondary oil recovery and tertiary oil recovery or enhanced oil recovery (EOR).

The invention also relates to green EOR technologies, because it does not necessitate applying chemical and/or biological agents that are harmful to the environment. In addition, the invention may find useful applications in related types of processes, for example, in increasing the capacity of injection wells, carbon dioxide injection wells, waste disposal wells and wells for the conservation of various materials.

Historically, the average level of oil recovery from a typical well has been approximately 30%. The unrecovered residual oil can be divided into four categories: oil stored in poorly permeable layers and non water-encroached layers—27%; oil in stagnant zones of homogenous horizons—19%; oil in lenses and behind impermeable barriers—24%; and capillary held and film oil—30%.

Oil producers strive to reach the maximal recovery of hydrocarbons from productive deposits at a minimal cost. As numerous oil reservoirs have been depleted worldwide, new advanced methods of enhanced recovery of oil and gas have to be developed in order to extract significant amounts of unrecoverable hydrocarbons left in the reservoirs. Still, no secondary or tertiary recovery-enhancing methods were found to be capable of substantially improving this level of recovery.

Numerous methods and devices for enhancing hydrocarbon recovery have been disclosed in addition to the conventional mechanical ones. The chemical, microbiological, thermal-gas-chemical and similar methods generally rely on using various agent-assisted processes, including: injection of steam, foam surfactants and/or air, the latter being accompanied by low-temperature or high-temperature oxidation, in situ formation of emulsions, directed asphaltene precipitation, chemical thermal desorption, selective chemical reactions in light oil reservoirs and heavy oil deposits, chemical agent-assisted alterations of phase properties, including wettability and interfacial tension, and alkaline-surfactant-polymer flooding, to name a few.

Alternatively, EOR can be achieved through stimulating the well/deposit permeability and improving oil mobility by means of agent-free apparatuses generally related to the following types of the equipment: ultrasonic, acoustic, electrohydraulic, electric hydro-pulse and electromagnetic emitter devices, as well as devices that are combinations thereof.

It has been reported that the oscillations supplied by an ultrasound (frequency>20 KHz) source can improve the permeability of much of the porous media surrounding the well. Accordingly, high-power ultrasonic apparatuses are used for the removal of barriers that block oil flow into the well, the reduction of particle clogging near the well bores and cleaning/clearing the near wellbore regions in the producing formations that exhibit declining production as a result of mud penetration, depositions and other undesirable processes. However, FOR through ultrasound does have a major disadvantage in that high-frequency waves are rapidly attenuated in naturally existing porous media, which results in a rather limited influence on the formation and bottom-hole zone. This leads to limited intensification of inflows and a moderate increase in oil recovery.

Most devices for EOR through ultrasound are designed for insertion into the wells/boreholes. All of these devices comprise an ultrasonic transducer and ultrasonic emitter(s) powered through a logging/power cable. The ultrasound treatment of the wells/boreholes focuses on an improvement in the filtering properties of productive intervals and is performed point by point, with the neighboring points usually being distanced between 0.5-1 meter from one to another. The efficiency of EOR through ultrasound is assessed based on the inflow profile-stimulation profile data. The ultrasound treatment is effective in approximately half of the cases. The improved permeability imposed by the ultrasound EOR is not permanent, although it may last for months.

It has been observed that both an enhancement of oil recovery and an increase in well intake were achieved through the action of seismic waves originating from earthquakes and waves that resulted from various human activities. Moreover, oil production can be promoted by sending seismic waves across a reservoir to liberate immobile oil patches. Seismic waves are mechanical perturbations that travel through the Earth at a speed governed by the acoustic impedance of the medium in which they are propagating. Apart from the ultrasonic waves, which are capable of affecting the local regions, the seismic waves may stimulate a whole reservoir, inducing a large-scale effect due to their low attenuation.

Low-frequency elastic waves of a low intensity can significantly increase the flow rate of yield-stress fluid under insignificant external pressure gradients. They promote entrapped non-aqueous liquid bubble mobilization and non-aqueous phase liquid transport in porous media by lowering the threshold gradient required for the fluid's displacement.

The propagation of surface acoustic (frequency is 20 Hz-20 KHz) waves depends on elastic and piezoelectric nonlinearity, and is characterized by a frequency shift due to external static stresses and electric fields. Nonlinear wave propagation is affected by the difference between non-dispersive and dispersive systems, with the two types being able to occur in electroelasticity. In dispersive media, self-focusing, self-modulation, envelope solitons, and the attenuation of surface waves takes place due to coupling the thermal and quantum fluctuations.

Heterogeneous porous reservoir media are nonlinear due to the plurality of both micro- and macro-defects, as well as grain-to-grain contact surfaces comprising multiphase fluids. In the porous reservoir materials, quasi-static and dynamic responses are mostly determined by the reservoir fluids. The nonlinear effects can significantly affect the efficiency of oil recovery, because oil trapping depends on permeability. In the low-frequency range, capillary forces and nonlinear rheology are the main mechanisms of seismic/acoustic stimulation. Nonlinear sound scattering by spherical cavities in liquids and solids and the stress-deformation in solids/media with micro plasticity, which are affected by wide-band random excitation and exhibit properties of hysteresis, are analyzed using multi-degree-of-freedom models. The interaction of acoustic waves in micro inhomogeneous media is stronger when compared to that in the conventional homogeneous media, which was observed with ground species, marine sediments, porous materials and metals.

Oil trapped on capillary barriers can be liberated when seismic amplitudes that exceed a certain threshold are followed by oil transfer under background pressure gradient(s). The movement is further enhanced by droplet coalescence. The effective force added by seismic waves to the background fluid-pressure gradient is estimated using poroelasticity theory. The fluid's pore-pressure wave and the matrix elastic waves are responsible for the increase in oil mobility. The rock-stress wave is the more efficient energy-delivering agent compared to the fluid pore-pressure wave in a homogeneous reservoir.

For through seismic vibration-assisted mobilization of oil has not yet been fully studied. In practice, seismic waves are generated using arrays of powerful sources placed on the earth's surface. The level of the introduced vibro-energy affects both residual oil saturation and relative permeability in the porous medium. Oil mobilization in homogeneous and fractured reservoirs can be altered via a fluid's oscillation in a well. EOR in the fractured reservoir's matrix zone and cross-flow induced by vibrations improves the imbibition of water into and explusion of oil out of the matrix zone.

The electrohydraulic method allows the enhancement of oil recovery by means of the restoration of filtration properties of a productive layer. The method comprises the generation of shock waves in a fluid as the result of the application of very brief, but powerful electrical pulses followed by the occurrence of shock waves with acoustical and hypersonic velocities.

U.S. Pat. No. 6,227,293 to Huffman et al. and U.S. Pat. No. 6,427,774 to Thomas et al. disclose processes and apparatuses for coupled electromagnetic and acoustic stimulation of oil reservoirs using pulsed power electrohydraulic and electromagnetic discharges. The combination of electrohydraulic and electromagnetic generators causes both the acoustic vibration and electromagnetically-induced high-frequency vibrations over an area of the reservoir. The effective range of the stimulation is limited to 6000 feet. In addition, the design of these combined generators is complex and they have sizeable dimensions, which limits their use with conventional boreholes: in some cases an additional well needs to be drilled for the placement of the generator.

Another approach illustrated in U.S. Pat. No. 6,499,536 to Ellingsen teaches a method that includes injecting a magnetic or magnetostrictive material through an oil well into the oil reservoir, vibrating the material with the aid of an alternating electric field and removing oil from the well. The method requires the use of additional materials and has disadvantages associated with the introduction of these solid materials into the productive layer, including a possible decrease in permeability.

A borehole acoustic source for the generation of elastic waves through an earth formation and the method of using it is disclosed in U.S. Pat. No. 7,562,740 to Ounadjela, and can be utilized for measuring the geological characteristics of the underground media surrounding the borehole. The method relies on using frequencies up to at least 1 KHz and is a geophysical research method and is not intended for EOR.

U.S. Pat. No. 6,597,632 to Khan discloses a method for determining the location and the orientation of open natural fractures in an earth formation by analyzing the interaction of two high-frequency and low-frequency seismic signals recorded in another wellbore. In this method, the low-frequency signal is transmitted from the earth's surface and the high-frequency signal is transmitted from the wellbore. The compression and rarefaction cycles of the lower frequency signal are used to modulate the width of the open fractures, which changes their transmission characteristics. As a result, the amplitude of the high-frequency signal gets modulated as it propagates through the open fractures. This method is applicable for subsurface fracture mapping using nonlinear modulation of a high-frequency signal, and is not intended for use with FOR purposes.

A method and apparatus for blasting hard rocks for the fracturing and break-up of the rock using a material ignited with a moderately high energy electrical discharge is disclosed in U.S. Pat. No. 5,573,307 to Wilkinson et al. The two electrodes of the reusable blasting probe are in electrical contact with a combustible material such as a metal powder and oxidizer mixture. Electrical energy stored on the capacitor bank ignites the metal powder and oxidizer mixture causing an increased dissipation of heat generating high-pressure gases fracturing the surrounding rock. Wilkinson teaches the utilization of oxidizing chemicals for rock fracturing, but not for the stimulation of oil production.

Yet another apparatus for generating pulsed plasma in a fluid is described in U.S. Pat. No. 5,397,961 to Ayers et al. A high-energy pulse is supplied to spaced electrodes for creating a spark channel and initiating the plasma. The pulse-forming network generates a pulse with the duration of 520 microsecond and gigawatts of power.

U.S. Pat. No. 5,425,570 to Wilkinson discloses a method and apparatus for blasting rocks with plasma. A capacitor bank is used for storing an electrical charge, which is coupled with an inductance that delivers the electric charge as a current through a switch to an explosive helically wounded ribbon conductor. The ribbon's dimensions correspond to the ratio of the inductance to the capacitance in order to ensure the efficient dissipation of an optimal amount of stored electrical energy.

It shall be noted that a number of EOR methods currently utilized in practice are based on linear dependencies/phenomena. However, the linear dependencies in nature can be viewed as the exceptions, rather than the rule due to the numerous possible combinations of various dependencies resulting in very diverse and uniquely complex effects.

For example, in the 1950s, a deviation from a phenomenologically derived constitutive Darcy's law, which is used to describe oil, water and gas flows through petroleum reservoirs, was observed and the nonlinear filtration law was discovered. The filtration rates of oil and oil-containing fluids vary greatly, depending on viscosity, pressure gradient and other conditions.

The multiphase systems and their nonlinear wave dynamics are of growing importance for state-of-the-art industrial applications, including: acoustics and shock waves in homogenous gas-liquid and vapor-liquid mixtures, dynamics of gas and vapor bubbles, wave processes in gas-liquid systems and on the interface of two media, wave propagation in a liquid medium with vapor bubbles, wave flow of liquid films and calculation of wave dynamics in gas-liquid and vapor-liquid media. Since a productive deposit is a dissipative medium with a combination of nonlinear oscillations in a wide range of frequencies, it is impossible to explain the origin of the processes by an occurrence of forced periodic wide-band oscillations using the general laws of physics. Nonlinear phenomena violate the principle of superposition. The response of a nonlinear system to a pulse with a certain length is not equal to the sum of its responses to shorter pulses with a duration of tens of microseconds. For instance, the system's response to two consecutive pulses with the duration $\Delta t$ each differs from its response to a single pulse with the duration $2\Delta t$.

The interaction of the wide-band, periodic, directed and elastic oscillations generated by the ideal nonlinear plasma source with a nonlinear, dissipative and non-equilibrium medium results in nonlinear wave self-action at the basic frequency. In this case, wave amplitude and frequency change depending on the intensity of the wave in the form of a single quasi-harmonic; the amplitude and the phase of this quasi-harmonic slowly change over time and space, as a result of the nonlinearity. Thus, the self-modulation effect is observed in the disturbed nonlinear system. Due to periodic pulse impact, the phase transition starts manifesting the transformation from one state to another. This transformation is accompanied by an increase in phase transition temperature, starting with bubble nuclei formation, and heat exchange. The periodic impact leads to the development of resonance oscillations at quasi-harmonic frequency under these conditions. The harmonic low-frequency oscillations last for a long period of time following impact termination.

Presently, with the cost of oil rapidly rising, it is exceedingly desirable to reduce time and to lower energy consumption in order to secure a profit margin that is as large as possible. However, prior art techniques do not offer the most efficient method of EOR in the shortest amount of time possible, especially in depleted and mature wells. Accordingly, there is a pressing need for a process and a device that adequately addresses the above described necessities in an advanced EOR, and will allow the enhancement of oil and gas recovery with minimal time for treatment and energy cost that would result in the improved characteristics of the wells/boreholes and their surrounding media. Such a process and device shall be capable of increasing both the recovery of hydrocarbons from deposits and the intake capacity of injection wells and that of waste storage wells. The advanced, compact and highly efficient device is particularly needed in the light oil production fields, where the depletion is a key concern. Several other objectives and advantages of the present invention are:

(1) To provide a device for treating wells/boreholes in an expedited manner with optimized energy costs;
(2) To ease operation, improve efficiency and reduce space taken up by the equipment;
(3) To provide a device for use with aggressive well media for any required period of time;
(4) To provide conditions for altering the permeability of the media surrounding the well and the mobility of associated fluids by passing through the surrounding media filled with the fluids the metallic plasma-generated, directed, nonlinear, wide-band and elastic oscillations at resonance frequencies following the controlled explosion of a calibrated conductor in the in-well plasma source;
(5) To provide conditions for the gradual, multi-step alteration of the medium's permeability and fluid mobility by subjecting the well's surrounding media and constituents of said fluids to the first shock wave event followed by subjecting the disturbed well surrounding media and affected constituents of said fluids to the second shock wave, etc.
(6) To provide a device for manipulating the capacity of land, onshore and offshore wells of predominantly vertical orientation with respect to the earth's surface or sea bottom and their surrounding media;
(7) To provide conditions to obtain capacity improvements resembling those of hydro cracking;
(8) To produce oscillations throughout the media/reservoir/deposit for a period of time sufficient for the efficient recovery of unrecovered hydrocarbons;
(9) To provide the device, wherein two or more plasma sources can be employed.

The present invention fulfills these needs and provides other related advantages.

SUMMARY OF THE INVENTION

In some embodiments, a plasma source can comprise a plasma emitter comprising a first electrode and a second electrode, the first electrode and the second electrode defining an electrode gap. In some embodiments, the plasma source can further comprise an enclosure housing attached to a distal end of the plasma emitter, the enclosure housing can comprise a delivery device configured to introduce a metal conductor through an axial opening in the second electrode and into the electrode gap and a device housing attached to a proximal end of the plasma emitter, the device housing can comprise a high voltage transformer electrically coupled to a capacitor unit. In some embodiments, the capacitor unit electrically can be coupled to a contactor, and the contactor can be electrically coupled to the first electrode.

Some embodiments comprise a system. In some embodiments, the system can comprise a plasma source which can comprise a plasma emitter comprising a first electrode and a second electrode, the first electrode and the second electrode defining an electrode gap. In some embodiments, the plasma source can further comprise an enclosure housing attached to a distal end of the plasma emitter, the enclosure housing can comprise a delivery device configured to introduce a metal conductor through an axial opening in the second electrode and into the electrode gap and a device housing attached to a proximal end of the plasma emitter, the device housing can comprise a high voltage transformer electrically coupled to a capacitor unit. In some embodiments, the capacitor unit electrically can be coupled to a contactor, and the contactor can be electrically coupled to the first electrode. In many embodiments, the system can further comprise a support cable comprising a fixed end and a remote end coupled to the plasma source and a ground control unit coupled to the fixed end of the support cable.

Many embodiments comprise a method. In some embodiments, the method can comprise providing a plasma source. In various embodiments, the plasma source can comprise a plasma emitter comprising a first electrode and a second electrode, the first electrode and the second electrode defining an electrode gap. In some embodiments, the plasma source can further comprise an enclosure housing attached to a distal end of the plasma emitter, the enclosure housing can comprise a delivery device configured to introduce a metal conductor through an axial opening in the second electrode and into the electrode gap and a device housing attached to a proximal end of the plasma emitter, the device housing can comprise a high voltage transformer electrically coupled to a capacitor unit. In some embodiments, the capacitor unit electrically can be coupled to a contactor, and the contactor can be electrically coupled to the first electrode. In some embodiments, the method can further comprise positioning the plasma source in a fluid medium, creating a metallic plasma in the electrode gap, generating a shockwave in the metallic plasma in the electrode gap, and transmitting the shockwave from the metallic plasma into the fluid medium to create oscillations in the fluid.

The present invention provides a unique and novel method for manipulating the permeability of the media surrounding the well and the mobility of associated fluids by using energy released upon the controlled explosion of a calibrated conductor in a plasma source submerged in well's fluid. The invention is directed to processes and apparatuses for increasing the recovery of hydrocarbons (crude oil and gas) from productive layers at all stages of development, and can also be used to enhance the injection capacity and profile of water injection vertical wells, carbon dioxide injection wells, waste storage wells and other wells, including inclined wells, wells with changeable direction or directional wells without horizontal completion. Due to the induced resonance effects in the hydrocarbon reservoir accompanied by the improved permeability and perforation and decreased colmatation/clogging, water cut decreases and well recovery rate increases and significantly higher production/injection capacities are achieved.

The present invention is directed to a plasma source for generating nonlinear, wide-band, periodic, directed, elastic oscillations. The plasma source comprises a plasma emitter having a first electrode and a second electrode. The electrodes define an electrode gap, wherein the plasma emitter has a plurality of metal stands disposed adjacent to the electrode gap and uniformly spaced about a perimeter of the plasma emitter. An enclosure housing is attached to a distal end of the plasma emitter. The enclosure housing contains a delivery device configured so as to introduce a metal conductor through an axial opening in the second electrode into the electrode gap. A device housing is attached to a proximal end of the plasma emitter. The device housing contains a high voltage transformer electrically connected to a capacitor unit, which is electrically connected to a contactor, which is in turn electrically connected to the first electrode, all contained within the device housing. The proximal and distal ends of the plasma emitter preferably have a conical or hyperbolic shape.

An emitter opening exists between each pair of the plurality of metal stands. The plurality of metal stands comprises three metal stands, each metal stand having an apex angle oriented toward the electrode gap, said apex angle of each metal stand being equal and measuring between ten degrees and sixty degrees. In a particularly preferred embodiment, the apex angle of the metal stands measures forty-eight degrees. The metal conductor preferably is a pure or homogenous, metal or metal alloy, electroconductive material or composite.

The first electrode is preferably a high voltage electrode and is coated or fusion bonded with a high melting point, refractory metal or alloy. Preferably, the first electrode is electrically insulated from the plasma emitter and the second electrode is electrically grounded to the plasma emitter. A distal end of the enclosure housing is shaped as a cone, a tapered cone, a convex cone, a projective cone, a twisted cone, or a pyramid. The distal end of the enclosure housing preferably has straight, round or spiral surface channels. The enclosure housing is preferably sealed and contains a dielectric compensation liquid. The device housing is also preferably sealed and contains a dielectric liquid.

The device housing further contains electronic and relay blocks electrically connected between the transformer and capacitor unit. The electronic and relay blocks control electrical signals passing through the capacitor, contactor, and first electrode. The capacitor unit preferably includes a Rogovsky coil in an electric discharge circuit.

The present invention is also directed to a system for stimulating wells and deposits through controlled, periodic oscillations. The system comprises a plasma source as described above. The system also includes a support cable having a fixed end physically connected to a mobile station and a remote end physically and electrically connected to the plasma source. The support cable is configured such that the remote end may be deployed into a well or deposit.

A ground control unit is mounted on the mobile station and electrically connected to the fixed end of the support cable. The ground control unit has a recording block configured to record and store data about the oscillations. A discharge interlock is included in the ground control unit and in electronic communication with the delivery device, capacitor, contactor, and first electrode of the plasma source. The discharge interlock is configurable so as to either allow or prevent a discharge of controlled, periodic oscillations from the plasma emitter.

The invention is also directed to a method for stimulating wells, deposits and boreholes through controlled oscillations. The method comprises the step of providing a plasma source as described above. The plasma source is submerged in a fluid medium in a well, deposit or borehole. The capacitor unit of the plasma source is powered with a working voltage of at least 6 kV and a capacity of at least 50 microfarads. The metal conductor is introduced into the electrode gap. The capacitor unit is discharged so as to provide electricity to the first electrode. A metallic plasma is created in the electrode gap through an explosion of the metal conductor. A shockwave is emitted from the metallic plasma in the electrode gap. The shockwave is directed from the metallic plasma into the fluid medium. Nonlinear, wide-band, periodic and elastic oscillations are generated in the fluid medium by the passage of the directed shockwave. The method may also include repeating the powering, introducing, discharging, creating, emitting and directing steps approximately every 50-55 microseconds. The inventive method is preferably performed excluding the use of chemicals that are harmful to humans or the environment.

The nonlinear, wide-band, periodic and elastic oscillations preferably have a frequency ranging from 1 Hz to 20 kHz. The nonlinear, wide-band, periodic and elastic oscillations preferably have a short pulse of approximately fifty to fifty-five microseconds and propagate through the fluid medium at low velocities.

The inventive method is preferably performed in combination with agent-assisted fracturing, hydro-slotted perforation, or heating through chemical or biological agents. The generating step preferably includes forming resonance oscillations in the fluid medium of the well, deposit or borehole. The method is preferably repeated through multiple, consecutive applications of the directed shockwave at various frequencies and/or at different locations within the well, deposit or borehole.

The well, deposit or borehole may include a vertical well, an inclined well, a well having a changeable direction, a directional well without horizontal completion, a production well, a mature well, a depleted well, a land well, an onshore or offshore well, an open hole, an injection well, a carbon dioxide injection well, a waste disposal well, a conservation well, or any manmade or natural earth opening.

The inventive method can be used for treating production, injection, mature, depleted, waste disposal, conservation, land, onshore, or offshore wells/boreholes/openings. Such wells may be oriented at any angle with respect to the earth's surface without horizontal completion. The inventive method is not ideal for wells intended for coal bed gas.

Using the inventive apparatus, the method comprises the steps of: lowering a plasma source into a well using a logging/power support cable, submerging the plasma source in the well fluid, creating a metallic plasma in a plasma emitter, sending shock waves created by the generation of the metallic plasma into the well fluid, directing the shock waves from the gap between electrodes to the well and surrounding media by three metal stands; generating non-linear wide-band, periodic, directed and elastic oscillations in the well and its surrounding media. Application of this method results in the emergence of long lasting resonance features; improving the permeability of the porous media; increasing the mobility of fluids in the well and surrounding media; and improving the well production/injection capacity and hydrocarbon recovery.

The inventive method may be used in the following applications: initiation of fluid influx to the well following development completion; enhanced oil recovery from cased hole and open hole production wells that are at the late stage of exploitation; rehabilitation of the production wells characterized with a total loss or diminished productivity following hydraulic fracturing; isolation of water-encroached horizons of multilayer formations without blasting operations or the installation of cement bridges; increase in the well injection capacity at the late stage of operation; redistribution of injected fluid in a reservoir for smoothing the injection capacity profile of wells in field conditions without applying chemical/biological agents and/or insulating well productive intervals; increase in the well intake of carbon dioxide; and increase in the well intake of waste materials.

The ground control unit of the apparatus may be provided with an electronic voltage stabilizer and power supply with a toroidal transformer having an incremental adjustment of output voltage. The ground control unit is preferably modular with parts and PCBs provided with interchangeable connectors and may be powered by an AC or DC electrical line, generator, solar, tidal or wind power supply with a voltage up to 300 V. The unit preferably has separate specialized circuit and PCB and a button for manual pin-point correction of metal conductor protraction. A recording block is provided to record/store data, including: date, time, operation duration and the number of pulses executed in the process of well treatment and signals to sensors installed on the plasma source and data from the sensors. The ground control unit is preferably mobile and is provided with a remote control.

The ground control unit is attached to the plasma source with a logging/power support cable carrying electric signals and having a length at least 5,000 meters. The plasma source has an impact resistant generally cylindrical body, with the two-electrode plasma emitter being generally open. The plasma source comprises the following details: a high-voltage transformer charger; electronic and relay blocks that control the switching of logging/power cable cores; connectors; a power capacitor unit; a contactor for initiating the discharge of the capacitor unit; and a pulsed, plasma emitter equipped with a high-voltage first electrode and a second electrode. The high-voltage first electrode is preferably oriented on top and has a tip with a concave shape that is suppressed into a protective disc. The second electrode is preferably oriented on bottom. A device for delivering the calibrated metal conductor is housed by an enclosure having the same diameter as the plasma source housing and may be attached to the plasma emitter by a threaded connection.

The calibrated metal conductor is preferably introduced by a delivery device that is enclosed in a metal enclosure, which may be removable. The metal enclosure is preferably located in the front or distal end of the plasma source and is filled with a compensation dielectric liquid. The delivery device comprises a spool for storing the calibrated metal conductor, a plunger core electromagnet having an axial opening with its core being attached to the dielectric platform connected to the plasma emitter's lower part with a flange; an L-shaped push type actuator with a sharpened/tapered trailing edge attached to the electromagnet core; and the plastic guiding bush with an axial opening for directing the metal conductor into the co-axial opening in the bottom electrode of the plasma emitter and then into the gap located between bottom electrode and top electrode for their bridging. The calibrated metal conductor may be fabricated of metal, an alloy, a composite or an electrically conductive material capable of initiating plasma chemical reactions. In an alternative embodiment, the delivery device for the calibrated metal conductor may also comprise a spring-loaded clip storing the precut calibrated metal conductor or a revolving cylinder with the precut calibrated metal conductor or spring-loaded clips of the calibrated metal conductor.

Alternatively, the power capacitor unit, transformer/charger, discharge initiation contactor and electronic and relay blocks are housed by separate impact-proof, hermetically sealed enclosures connected to one another by flexible cables and secured with chains, belts, springs or similar connections. All flexible connected elements may be secluded in impact-proof flexible enclosures such as bellows, plastic/rubber hoses or flexible tubular enclosures.

The plasma emitter preferably comprises first and second electrodes made from high melting point/refractory metals or alloys and/or are coated with high melting point/refractory metals or alloys.

The front or distal end of the plasma source is protected by a removable impact resistant enclosure having the form of a cone, tapered cone, convex cone, projective cone, twist cone or pyramid with or without straight, round or spiral surface channels. The emitter of the plasma source is preferably surrounded by three stands having triangular cross-sections with the angles of ten to sixty degrees being oriented toward the inter-electrode gap. The plasma source comprises a disc isolating the body of the high-voltage first electrode from any generated plasma with the exception of its tip.

The plasma emitter comprises the high-voltage first electrode attached to the plasma source housing, containing the high-voltage transformer charger; electronic and relay blocks; connectors; the power capacitors' unit; and contactor for initiating the capacitors' unit discharge. The high-voltage first electrode is surrounded by a plastic sleeve possessing rubber seals. The second electrode is attached to the plasma emitter and in electrical contact therewith, having an axial opening for protracting the calibrated metal conductor to the high-voltage first electrode.

There are numerous ways to describe wave propagation in a porous medium, including Biot's low-frequency equations. The rate of propagation of the disturbance in an elastic porous medium saturated with fluid is characterized by the piezoconductivity coefficient, which depends on the porous medium structure, for example, the diameter of the pores and the elastic modulus of a productive deposit.

Disordered oscillations sustained by both natural disturbance sources, such as the sun, the moon, tides, earthquakes; and man-derived disturbances, such as vibrations due to auto traffic, railroads and other activities, occur continuously in the productive deposits. Since the oscillations take place in dissipative closed systems, their characteristics are determined by the properties of these systems. Therefore, a productive deposit is an assembly of oscillating systems; it is a nonlinear oscillator existing in a non-equilibrium, dissipative and elastic medium. Thus, the periodic, directed and elastic oscillations induced by the nonlinear wide-band source can be used for the treatment of multi-layer productive deposits on a large scale to increase the permeability of the media, improve the mobility of oil and gas and enhance the production capacity and injection capacity of the wells.

The superposition principle is not applicable to nonlinear systems. In general, nonlinear media do not support propagation of constant speed waves that have arbitrary amplitude and shape. However, some nonlinear media, for certain amplitudes, admit the propagation of constant speed periodic or pulse waves of definite shape; in others, the admitted waves have neither a definite shape nor a constant speed. Waves having a constant shape that can propagate at a constant speed are stationary waves, whereas those that have neither a constant speed nor shape are non-stationary. There is also a special class of quasi stationary waves called simple waves. The technique for the determination of possible stationary and non-stationary waves in a given nonlinear medium is dependent on whether they are periodic, aperiodic or quasi periodic waves.

The description of nonlinear wave processes can be complex comprising the following: (a) kinematic analysis related to the determination of possible stationary wave processes supported by the system, and (b) the dynamic description related to the excitation of these stationary waves and the subsequent evolution of non-stationary waves. At the kinematic level, the stationary wave description at a weak level of nonlinearity is compared to that at a strong level. The waves may be quasi-harmonic at low levels for systems in which stationary wave solutions exist. In dispersive distributed systems, the description yields the equations of motion for the space-time variation of the amplitude, temporal and spatial frequencies, etc. of non-stationary solutions, wherein finitely extended wave packets are formed by superposition of different constant amplitude and frequency stationary solutions.

A unique feature of a non-equilibrium system is that even a weak shock wave that periodically acts on the system can cause a disproportionally large disturbance. The nonlinear dependence exists between the in-well plasma source of the wide-band, periodic, directed and elastic oscillations and the productive deposit, which is a nonlinear natural oscillator.

When the productive deposit is subjected to the action of the wide-band, periodic, directed and elastic oscillation source, a capture of the dominant frequency takes place: oscillations and waves interact until a quasi-harmonic wave emerges, which propagates through the stratum-resonator and stimulates media. Each layer of the productive deposit is characterized by its intrinsic resonance frequency. The disturbed dissipative media feature dispersive properties. The activation results in the formation of bubbles that move to the reservoir's top and oil droplets that migrate in a downward direction.

Due to the extraction of the gas bubbles, the amplitude of the induced oscillation significantly increases. In the bubble medium, all acoustic oscillations overturn the low-frequency oscillations; the values for the coefficients of reflection, refraction and absorption alter. Some of the bubbles explode/implode promoting both the thermal exchange and the mass exchange. The oil viscosity decreases while its mobility improves along with the changes in rheological, tixotropic and other properties leading to the increase in permeability and EOR.

The harmonized oscillations travel at a speed at which the linear waves cannot spread. Depending on geological characteristics of the productive deposit, the induced oscillations can propagate over significant distances for several thousand meters and can last for a long period of time, following shock wave occurrence. As a result, the following effects are observed: (a) the redistribution of the dissipative media according to density; (b) the decrease of surface tension of transient water-oil-gas section; and (c) the increase in well production capacity along with the decreased water cut.

The present invention is based on multifaceted nonlinear processes and phenomena, and is capable of the substantial enhancement of the production of petroleum oil and natural gas from subterranean reservoirs, especially from mature wells and production wells that have been severely depleted. The invention can also find application in geophysical studies, the enhancement of injection well intake capacity for water flooding, carbon dioxide flooding, surfactant flooding and diluents flooding, as well as for the underground conservation of carbon dioxide and various waste/requiring special storage conditions materials.

In the invention, the nonlinear processes and related phenomena in the well/borehole and in the well's immediate and remote surroundings are initiated by a plasma source, which constitutes the main part of the inventive apparatus. The inventive process includes the interaction of nonlinear oscillations generated by the plasma source and nonlinear processes occurring in the productive deposits and the reservoirs and their surroundings. While extreme pressure or tremendous heat can be disadvantageous, the outcome of controlled processing is highly beneficial.

The time profiles of shock wave pressure in fluid can be established using the explosion of a submerged wire triggered by the discharge of the accumulated energy through it. The pressure of the shock wave generated in fluid depends linearly on the peak voltage across the exploding wire. With the same heating rate, alloy wire reaches a highly resistive state more rapidly than the metal wire. The chemical reactions of the exploding wire material and the surrounding fluid play an insignificant role in the generation of detonation waves.

The present invention relates to green technologies, because it is free of harmful chemicals and is an ecologically safe approach, which sets it apart from conventional fracturing methods. This notwithstanding, the inventive process can be used in combination with existing methods and new methods or a combination thereof, including agent-assisted fracturing methods, hydro-slotted perforation (slit-cutting) or heating the well bore area using chemical or biological agents.

The inventive process and apparatus are meant for enhancing the capacity of both production wells and injection wells by means of creating resonance waves in the surrounding media to stimulate the productive layers and improve deposit permeability and fluid mobility. The process and the apparatus can be used in the following applications, among others: initiation of fluid influx into the well following development completion; FOR from cased hole and open hole production wells that are at the late stage of exploitation with water cut in the extracted fluid reaching 90-95%; rehabilitation of production wells characterized with a total loss or diminished productivity following hydraulic fracturing; isolation of water-encroached horizons of multilayer formations without blasting operations or the installation of cement bridges; increase in total well injection capacity at the late stage of operation; and redistribution of injected fluid in a reservoir for smoothing the injection capacity profile of wells in field conditions without applying chemical/biological agents and/or insulating well productive intervals.

The present invention is based on inducing resonance and other effects, which occur in the wellbore zone and surrounding media due to the action of the nonlinear source of wide-band, periodic, directed and elastic oscillations in the well followed by the interactions of these oscillations with nonlinear natural media. Therefore, the present invention creates beneficial conditions that cannot be duplicated, because the process' efficiency is enhanced by multiple, consecutive applications of shock waves and oscillations of various frequencies, applied at different locations within a short period of time.

The preferred embodiments of the present invention apply optimized levels of oscillations via controlled plasma generation. The process is independent of external temperatures and pressure, and provides a means of changing physical properties and characteristics of fluids evenly throughout the reservoir. In addition, important economic benefits are experienced through implementing the present invention. The optimized usage of an in-well plasma source serves to lower equipment, handling and energy costs, as it improves the efficiency and the productivity of the treatment.

Both the considerations of physics that underline the applicable phenomena and the technical design of the apparatus of the present invention drastically differ from all of the existing methods and EOR devices in their effects on the productive deposits. The inventive plasma source generates periodic oscillations with a short pulse (approximately 50-55 microseconds) and induces nonlinear oscillations and waves that propagate at low velocities throughout a productive reservoir. All of the acoustic waves become low-frequency waves due to the periodic impacts. The principles underlying the apparatus' design allow the evaluation of the efficiency of the treatment of production wells and that of injection wells in order to increase the intake of water, carbon dioxide and/or other materials.

The present nonlinear plasma source of wide-band, periodic, directed and elastic oscillations features high technological efficiency and the reliability of all its components. The plasma source of the claimed invention is capable of generating wide-band, periodic, directed and elastic oscillations in wells and boreholes and/or their surroundings, including: deposits, strata, productive intervals media and reservoirs. The plasma source is specially designed for placement into vertical production wells, mature wells, depleted wells, boreholes, open holes, injection wells, carbon dioxide wells, waste disposal wells, inclined wells, wells with changeable direction or directional wells without horizontal completion or any other man-made or openings in the earth openings, except the wells intended for coalbed gas. The plasma source comprises the following details: a metallic plasma emitter equipped with two electrodes and three stands that direct shock waves; a capacitor's unit for energy storage; a contactor for discharge initiation, a calibrated metal conductor for bridging the electrodes and forming the plasma; and a device for delivering the calibrated metal conductor.

The source's design allows its weight and size to be minimized, as compared to the devices disclosed in U.S. Pat. No. 4,345,650 to Wesley, U.S. Pat. No. 6,227,293 to Huffman et al. and U.S. Pat. No. 6,427,774 to Thomas et al. It shall be further emphasized that the apparatus and/or the plasma source can be provided with various sensors for the detection of temperature, level, pressure, moisture and hydrocarbons and/or other detecting devices to obtain feedback control.

The inventive apparatus is highly reliable and efficient due to its optimized design, which takes into consideration the uniqueness of the nonlinear response of productive hydrocarbon deposits. The apparatus' plasma source is equipped with electrodes made of heat resistant materials. Despite the high-temperature discharge, the electrodes do not require an enhanced cooling system, as, for example, the device disclosed in U.S. Pat. No. 6,227,293 to Huffman et al.

Apart from the pulsed electrohydraulic and electromagnetic devices disclosed in U.S. Pat. No. 6,227,293 to Huffman et al., U.S. Pat. No. 6,427,774 to Thomas et al. and U.S. Pat. No. 7,849,919 to Wood et al. and developed for the recovery of crude oil, the present invention features many distinctive technological innovations and advanced design solutions, which are aimed at sustaining the device's performance and achieving the target efficiency of the stimulation of productive hydrocarbon deposits. To meet the requirements for safe operation and any applicable safety rules, the ground control unit of the apparatus is housed by a mobile station and can be located at a remote distance from the in-well plasma source.

A critical and distinguishing feature of the present invention is the integration of an electronic voltage stabilizer and a power supply equipped with a toroidal transformer with an incremental adjustment of the output voltage for eliminating plasma source failure resulting from an unstable input AC voltage.

The ground control unit has a recording block to record and store data and log files, including: date, time, operation duration and number of pulses executed during the well/borehole treatment, among other parameters.

Other unique features of the present invention are a separate specialized electric circuit and an additional printed circuit board (PCB) that have been developed for the pinpoint correction of metal conductor protraction by an operator manually using a dedicated button of the ground control unit. To ensure the quick response of an operator in the event of device failure, an interlock having a sound alarm and light (LED) alarm is installed in the ground control unit's panel. The claimed invention has additional prominent and substantive distinguishing features such state-of-the-art electric circuit schematics of the ground control unit, which comprises digital electronic components and advanced PCBs.

A noteworthy feature of the given invention is that all of the parts of the ground control unit are modular, and the parts and the PCBs are provided with connectors for uncomplicated and expeditious replacement and/or repair. This design increases reliability, improves efficiency and simplifies both maintenance and repair operations. The ground control unit is enclosed in a securely locked, impact resistant case, for example, a Pelican case.

High-voltage circuits of the plasma source are made for placing in production wells, mature wells, depleted wells, land wells, onshore wells, offshore wells, boreholes, open holes, injection wells, wells for carbon dioxide injection, waste disposal wells, conservation wells and other man-made or natural openings. Therefore, they are designed with all of the electrical contacts and connections provided with electrical threaded connectors instead of conventional soldering in order to eliminate contact burning and short circuiting.

A unique feature of the invention is that the front end of the housing of plasma source is equipped with a conical removable enclosure made of impact resistant material. The enclosure prevents accidental clinging and damaging of the plasma source in the process of moving it along the well/opening and protects the logging cable from breakage and tear rupture.

The plasma source of the present apparatus includes next generation high-voltage capacitors with the working voltage of 6 kV and a capacity of 50 microfarads each. The capacitors are small and lightweight. This allows the extension of the length of the logging carrying/pushing cable, which the plasma source is attached to, to at least 5,000 (five thousand) meters for the insertion into the well with the corresponding depth. The plasma source can operate at a well fluid temperature of up to 100 degrees Celsius. The energy that is stored on the power capacitors' unit sustains the metallic plasma resulting from the explosion of the calibrated metal conductor, located in the inter-electrode gap of the plasma emitter of the plasma source. The explosion occurs in the well fluid, which increases the power density of the generated shock wave directed by guiding stands.

The plasma source is equipped with a compact, highly reliable contactor which is far superior when compared to an air discharge arrester. The contactor initiates an electric discharge of the power capacitors' unit through the calibrated metal conductor. This design solution allows the plasma source size to be decreased and simplifies the electrical schematics.

An additional advantageous aspect of this invention is the design of a high-voltage electrode allowing easy assembling/disassembling of the electrode during maintenance service. To substantially increase the operation life of the electrode, it is coated or fusion bonded with a high melting point/refractory metal and/or alloy.

The plasma source comprises two electrodes. With the plasma source being placed vertically, as it would in case of its insertion in a vertical well, the high-voltage electrode is the top one. The high-voltage electrode has a concave shape and is separated by a disc. The concave tip of the high-voltage electrode is suppressed into the disc in order to exclude both failure and electrical leakage from this electrode to the plasma emitter's body. The electrode is attached to the plasma emitter with a special plastic sleeve with rubber seals. The sleeve serves as an electric insulator and prevents the penetration of well fluid into the plasma source at excessive pressures.

With the plasma source being positioned vertically, the second grounded electrode is located below the top high-voltage electrode. This bottom electrode consists of two parts and has no threaded connections. Therefore, it does not require alignment which substantially improves its reliability and durability. The bottom electrode has an axial opening for protracting the calibrated metal conductor through the opening upward to the top high-voltage electrode. The bottom electrode is attached to the plasma emitter with a specially shaped nut. It shall be noted that the bottom electrode and the plasma emitter are in electrical contact.

The device for delivering the calibrated metal conductor is located in the front end of the plasma source and is connected to the plasma emitter with a flange. All of the details of the device for delivering the calibrated metal conductor are mounted on a dielectric platform, including a spool for storing the metal conductor. The delivery device comprises a plunger core electromagnet having an axial opening for passing the metal conductor. The core is attached to the platform. An L-shaped push type actuator with a sharpened/tapered trailing edge is firmly attached to the electromagnet's core. As the plunger moves back-and-forth, the push type actuator's edge pins the conductor tightly to the platform and assists with sliding the conductor through a plastic guiding bush and the bottom electrode opening until the conductor is brought in the contact with the top high-voltage electrode. The design solution provides a highly reliable bridging of the two electrodes by means of the calibrated metal conductor, and sustains the repetitive generation of metallic plasma in accordance with the desired operation mode.

It should be noted that the device for delivering the calibrated metal conductor can be designed differently regarding the storage detail and transporting mechanisms: the latter can be fulfilled in the form of one or more spring-loaded clips having a number of precut pieces of the calibrated metal conductor or can be fabricated as a revolving cylinder having precut calibrated metal conductors.

The device for delivering the calibrated metal conductor is housed by a metal hermetic enclosure in order to protect it from mechanical damage and/or other adverse effects of the well fluid. The enclosure is filled with special compensation liquid, which prevents the well fluid from penetrating into the delivery device. The shape of the enclosure's front end minimizes accidental clinging during the movement of the plasma source along the well/borehole/opening.

The upper part of the plasma emitter is attached to the plasma source's main solid housing by means of a threaded connection. Special ring seals prevent the penetration of well fluid into the plasma source at excessive pressures. The pressure pulse/outgoing shock wave occur following the explosion of the calibrated metal conductor, situated between the electrodes, and the generation of metallic plasma.

The inter-electrode spacing of the plasma emitter's center is surrounded by three stands that feature triangular cross-sections with the angle of 48 degrees being the closest to the inter-electrode gap. In the second preferred embodiment, the angle of the triangular cross-section of the stands, which is the nearest to the inter-electrode zone, is 10-60 degrees. The length of the stands and their cross-section shape can vary greatly, depending on the requirements of the process, shock wave properties and desired treatment outcome. The stands direct the outgoing shock wave(s) generated by the pressure pulse in the fluid to the well, the interlayer, the deposit and/or other media/objects. The predominant direction of the propagation of the directed shock waves is the radial direction (perpendicular to the borehole axis). For example, the direction is horizontal with respect to the earth' surface in the vertical borehole. The directed shock waves propagate within the sum angle of up to 330 degrees along the perpendicular cross-section of the well. In the absence of significant diffraction, reflection, interference and other related phenomena, the length of the co-axial section of the borehole which is subjected to the action of the directed shock waves is defined by the distance between the top surface of plasma emitter and the bottom surface of the emitter, i.e. the height of plasma emitter. To provide an uninterrupted treatment of the well in the axial direction (along the borehole axis), the plasma source has to be moved along the well and the calibrated conductor shall explode every 1-3 feet.

To enlarge the well's area affected by the plasma source treatment and to cut the associated expenses through the increase in the distance between the treatments points, the top and/or the bottom of the plasma emitter can be shaped as cones. For example, the angle formed by the conical surfaces of the two facing cones, each having a conical tip with a 60 degree angle apex, is equal to 120 degrees in the cross section of plasma source along its length. In another embodiment, the facing conical surface(s) is/are hyperbolic in shape in the cross section of plasma source along its length. The two embodiments allow to direct shock waves in both perpendicular planes and longitude planes (along the well). As a result, the efficiency of the plasma source treatment dramatically increases. The distance between the neighboring treatment points is enlarged by 10-20 times, decreasing the well's treatment time and prolonging the operational life of the plasma source.

In the preferred embodiment, the calibrated metal conductor of the present invention is made of a pure and/or homogeneous metal. The explosion of the calibrated metal conductor consumes all of the energy stored on the capacitors' unit resulting in a pressure and temperature that are significantly higher than those in a plethora of industrial processes.

The calibrated conductor can be fabricated from an alloy, an electroconductive composite or other suitable electroconductive matter. Upon the careful selection of the composition and properties of the alloy and/or the composite material, the target chemical reaction(s) may be initiated following the explosion of the calibrated conductor, which may significantly enhance the effect. The yield of chemical compounds depends on their thermal stability: the more thermally stable they are, the higher their yield. In addition to plasma chemical reactions, organic reactions, metal-organic reactions and/or catalytic processes can be initiated.

Under certain conditions, nanoparticles of the conductor can be created following the explosion, which may allow the carrying out of beneficial chemical reactions in the well fluid. The further alteration of the well fluid properties results from the reactions taking place in adjacent layers of fluid.

The ground control unit of the apparatus includes an alarm indicator/interlock for electric discharge control. It allows an operator to control the movement pitch of the metal conductor and the electric discharge amplitude, as well as to shut down the plasma source in case of the plasma emitter idling/faulting.

The nonlinear plasma source of wide-band, periodic, directed and elastic oscillations is designed to be utilized in wells for their pulsed plasma stimulation. It comprises the power capacitors' unit for energy storage; the charger, the discharge initiation contactor, the electronic and relay blocks, the two-electrode plasma emitter and the device for delivering the calibrated metal conductor in the inter-electrode gap. The device for delivering the calibrated metal conductor regulates the length of the conductor piece required for electric contact bridging of the two electrodes. The delivery device is equipped with a storage spool with a wound calibrated metal conductor and electromagnetic mechanism that transports the conductor. The electromagnet core houses a frame with a push type actuator and a guiding bush for the precise direction of the metal conductor into the axial opening in the bottom electrode.

The device for delivering the calibrated metal conductor is mounted using three screws and is housed by a hermetic metal enclosure that is located at the front end of the plasma source. The enclosure has a conical shape, a tapered cone form or other suitable shapes to minimize damage to the plasma source and reduce clinging of the plasma source during movement along the well. Both the device and the enclosure can be readily detached for carrying out maintenance service or repair in field conditions.

Under operation conditions, the enclosure and the delivery device is filled with dielectric compensation liquid. This liquid serves as an insulator and prevents the well fluid from penetrating into the delivery device. Another important distinct advantage of the invention is that this dielectric liquid cools the bottom electrode which allows the significant increase of the operating lifetime of the bottom electrode. Therefore, apart from other devices, the bottom electrode does not require a specialized cooling system. As a consequence, the size of plasma source can be advantageously reduced.

With the dielectric compensation liquid, it is possible to operate the plasma source in aggressive well media for any required period of time. Another important distinct advantage of the invention is that this dielectric liquid allows the regulation of the periodicity of pulses and the pulse power.

The ground control unit is connected to the plasma source, designed for submerging in the well fluid, through the logging/power cable with a required number of strands. The cable may serve as pushing cable and can be secured with a chain.

The plasma source houses an electronic block and a relay block. The two blocks provide necessary electric schematic switching within the required time frame.

Other features and advantages of the claimed invention will become apparent from the following intricate description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 8 presents a table showing data on the effects of the treatment on the production capacity of various wells.

FIG. 9 presents further tables showing data on the effects of the treatment on the production capacity of various wells.

DETAILED DESCRIPTION OF THE PREFERRED EMBODIMENTS

Figure 1:
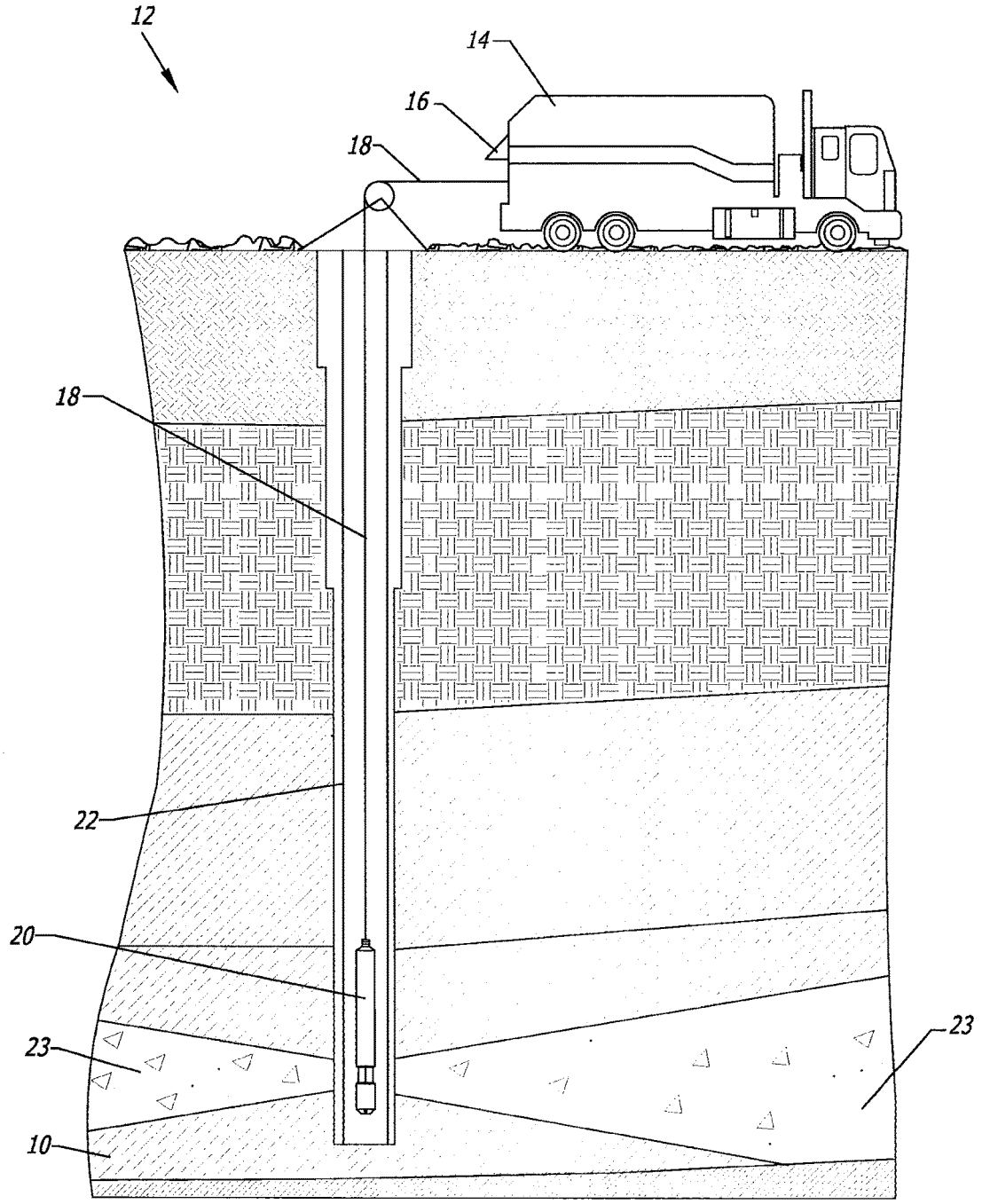
FIG. 1 is a diagram of an apparatus with a plasma source of elastic oscillations placed in a well.

The present invention is directed to a process and device for use in the oil and gas production industry and is intended to enhance the recovery of oil and natural gas from well sources and intake capacity of water injection wells for the increase of the intake capacity of water, carbon dioxide injection and other miscible agents.

The objectives of the present invention are achieved by using a nonlinear source of wide-band, periodic, directed and elastic oscillations to stimulate gas, liquid and solid media at the resonance frequencies, while the induced response of the disturbed media cannot affect the source. The beneficial effects gained through the present invention cannot be achieved with other methods, because the conditions created in the multi-point treatment cannot be duplicated by other means. In a prior art ultrasound-induced process, the transmission is low due to scattering and diversion, limiting the effective distance. In practice, it is necessary to consider the cost of the device and operation and maintenance expenses. An operator of the inventive apparatus is not required to wear high performance safety products for hearing protection as it would be in the case of the prior art high-frequency ultrasound equipment.

The plasma source of wide-band, periodic, directed, elastic oscillations is nonlinear, insofar as it releases energy stored in capacitors in the form of metallic plasma within a brief period of time in a limited volume accompanied by an increase in the temperature of 28,000 degrees Celsius and higher and a high-pressure shock wave with a pressure exceeding 550 MPa. The plasma source induces elastic oscillations having significant amplitude/power in nonlinear, dissipative and non-equilibrium media. The nonlinear source of periodic, directed and elastic oscillations is wide-band, insofar as the acoustic frequency spectrum generated by a short plasma pulse covers the band from fractions of a hertz to tens of kilohertz.

The apparatus for generating nonlinear wide-band, periodic, directed, elastic oscillations consists of a ground control unit, a logging/power carrying/pushing cable and a plasma source, with the latter comprising the following details: a plasma emitter with two electrodes, a high-voltage capacitor unit generally having a voltage of 6 kV and capacity of 250 microfarads, an electronic block, a Rogovsky coil installed in an electric discharge circuit of the capacitor unit, a relay block and a device for delivering the calibrated metal conductor in an inter-electrode gap. The Rogovsky coil extends the operational life of the capacitor unit and enhances reliability and decreases energy consumption during each electric discharge cycle.

The delivery device is housed in an enclosure filled with compensation dielectric liquid, and is located in the front end of the plasma source. The device for delivering the calibrated metal conductor includes a spool with the wound calibrated metal conductor and the components for transporting the conductor.

To perfect the communication process between the ground control unit and the in-well plasma source, which is carried out through the logging/power cable having a limited number of cores, the plasma source is provided with an electronic block and a relay block. The logging cable carries power/signals to and from the in-well plasma source and supports its weight. The electronic block and relay block secure necessary electric schematics switching within the required time sequence.

The ground control unit is equipped with an electric discharge alarm/interlock, which improves an operator's ability to act in a timely manner. The alarm/interlock controls the delivery of the calibrated metal conductor into the inter-electrode space as well as the electric discharge power, and shuts down the plasma source in case of the plasma emitter faulting. The operator of the ground control unit controls the plasma source by means of signals transmitted through the logging/power cable. The ground control unit consumes approximately 500 W, and can be powered from AC line voltage, a portable generator, a solar battery, a wind turbine, a tidal wave generator, other AC voltage source or a suitable DC voltage source.

The present invention is directed to a method for treating wells/boreholes with the plasma source. The method begins with introducing the plasma source in the well followed by its subsequent submerging in the well fluid. The inventive apparatus consists of a ground control unit, a logging/power cable and a removable/changeable plasma source for placing in boreholes, wells and other man-made land openings, including those made using directional drilling, or existing natural openings. In addition, the apparatus can be used in onshore/offshore wells. To ensure the uninterrupted operation in field conditions, the apparatus is provided with a spare plasma source. The apparatus can be serviced on site and/or in the field and can be transported by an off-road vehicle, boat or any other suitable means of transportation.

As illustrated in FIG. 1, a productive hydrocarbon deposit is a natural multilayer formation characterized with bulk modulus elasticity. The deposit contains non-equilibrium dissipating gas and fluid with their vertical distribution depending on the density of the fluid filling the pores. The volume of the effective pores is affected by the capillary and gravitation forces in the productive reservoir.

As can be seen from FIG. 1, the inventive apparatus 12 for inducing nonlinear, wide-band, periodic, directed and elastic oscillations in the hydrocarbon deposit aimed at the EOR of wells/boreholes encompasses mobile station 14 having a ground control unit 16, a geophysical armored logging/power support cable 18 and a plasma source 20 placed in a well/borehole 22 and emits shockwaves 23 therein. The mobile station 14 is provided with an autonomous energy source and a truck-mount cable winch or similar equipment to extend and retract the support cable 18 allowing the transportation of plasma source 20 along the well 22.

The support cable 18 carries power and electrical signals from the ground control unit 16 to the plasma source 20 inserted in the well 22 and carries feedback electrical signals, if necessary. In addition, the logging carrying cable 18 supports the weight of the plasma source 20 and can reach at least 5,000 (five thousand) meters in length. A pushing logging cable 18 is used for directional, non-vertical boreholes/openings 22 and those with a changeable direction. The plasma source 20 is moved up and down (in/out in vertical and directed non-vertical boreholes/openings without a horizontal completion) the well/borehole 22 using a cable truck-mount winch or other similar device that regulates the length of the logging/power cable 22.

Figure 2:
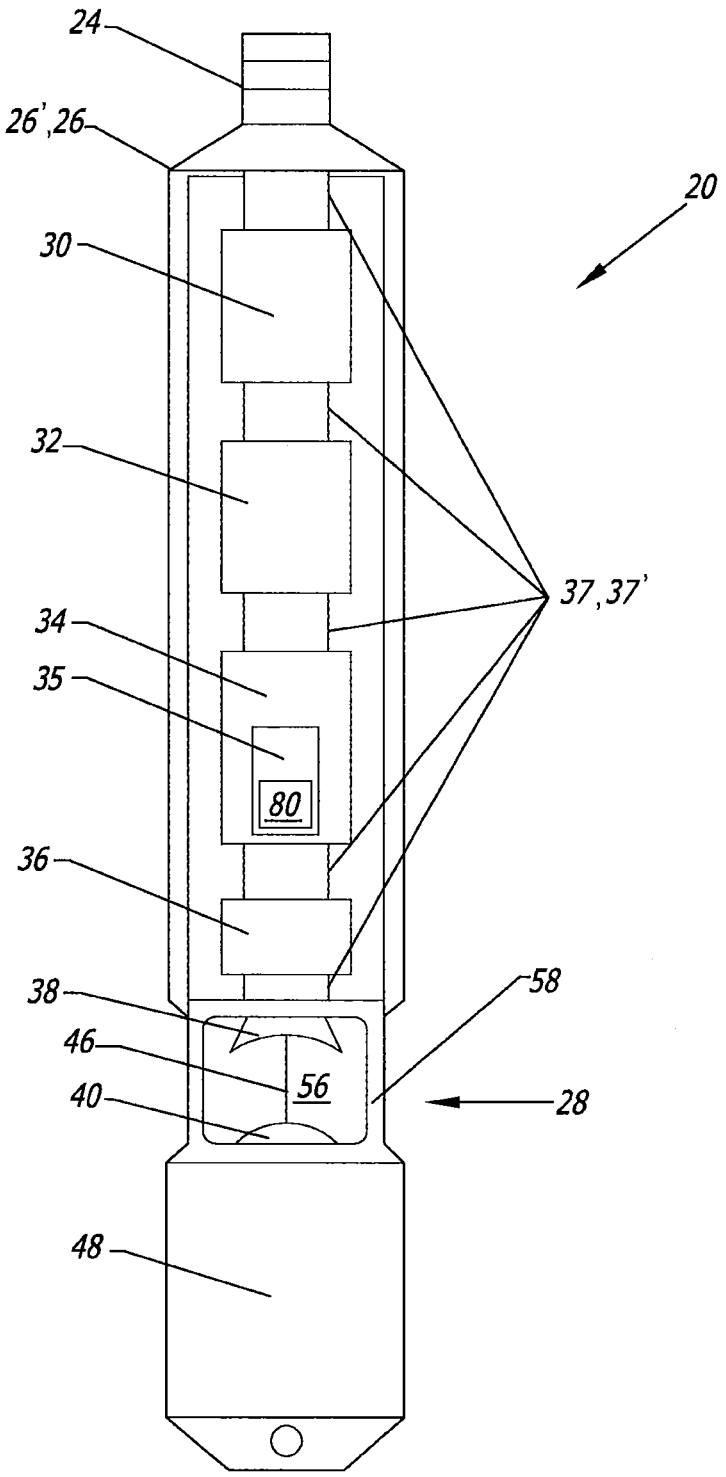
FIG. 2 is a diagram of a plasma source of the present invention.

The plasma source 20 depicted in detail in FIG. 2 is provided with an adapter 24 for a hermetically sealed connection to cable 18. The upper portion of the plasma source 20 is enclosed in an impact resistant, generally cylindrical hermetic housing 26 and attached to a two-electrode plasma emitter 28 being left open. The plasma source 20 preferably has an outer diameter of approximately 3.5 inches to allow the insertion of the plasma source in conventional casing/piping. In an alternate embodiment, the outer diameter of the plasma source 20 may be approximately 2.5 inches or smaller to allow its insertion in smaller production piping, i.e., 2.75 inches in diameter.

Figure 6:
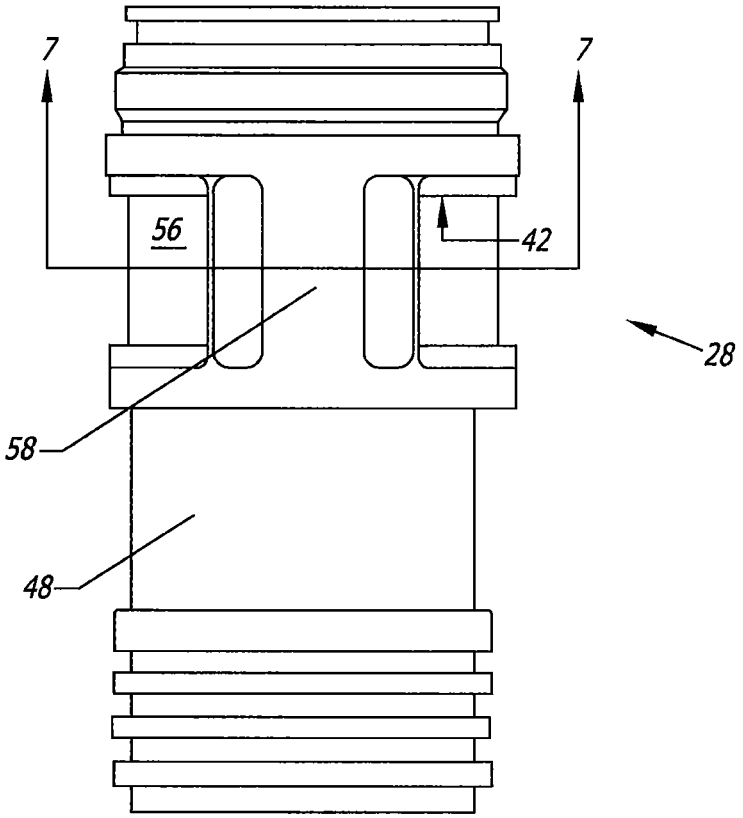
FIG. 6 is an illustration of the plasma emitter and metal stands to direct a shock wave.
Figure 7:
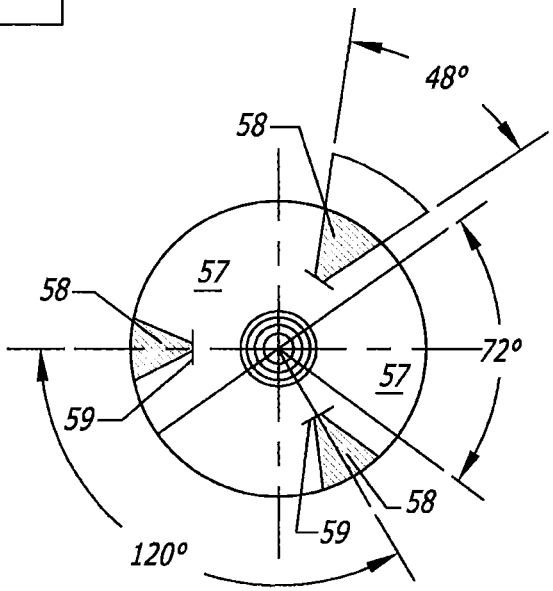
FIG. 7 is a cross-section of the plasma emitter and metal stands taken along line 7-7 of FIG. 6.

Plasma source 20 further comprises: a high-voltage transformer charger 30, electronic and relay blocks 32 that control the switching of cores in the logging/power cable 18, a power capacitor unit 34; a contactor 36 for initiating discharge of the capacitor unit 34, and the pulsed plasma emitter 28 equipped with a high-voltage first electrode 38 and second electrode 40. The transformer charger 30, electronic and relay blocks 32, capacitor unit 34, contactor 36, and first electrode 38 are attached in series by a plurality of connectors 37 as shown. The first electrode 38 is attached to the plasma emitter 28 with a plastic sleeve 42 and rubber seals (FIG. 6). The plastic sleeve 42 serves as an electric insulator and prevents the penetration of well fluid into the plasma source housing 26 at excessive pressure. Calibrated metal conductor 46 is transported by a delivery device 50 housed by enclosure 48 located in the front end of plasma source 20. Enclosure 48 (FIG. 2, 5) preferably has the same diameter as housing 26 and is attached to the plasma emitter 28 by a threaded connection. Metal enclosure 48 featuring body 52 is filled with dielectric compensation liquid 54 to prevent the influx of well fluid into the delivery device 50. Liquid 54 also cools the second electrode 40. As illustrated in FIGS. 6 and 7, the gap 56 between electrodes 38 and 40 is surrounded by three metal stands 58. The three metal stands 58 are equally spaced about the circumference of the plasma emitter 28 (FIG. 7) and are configured to direct the pressure pulse/shock wave 23 to the well and surrounding media (FIG. 1). In a preferred embodiment, the metal stands 58 each have a generally triangular shape with an apex angle 59 (the part of the triangle oriented toward the electrode gap 56) of between ten degrees and sixty degrees. Having the metal stands 58 equally spaced about the circumference of the plasma emitter 28 results in three equally sized emitter openings 57 of between sixty degrees and one hundred ten degrees. In a particularly preferred embodiment (FIG. 7), the apex angle 59 of the metal stands is forty-eight degrees resulting in three emitter openings 57 of seventy-two degrees.

Figure 3:
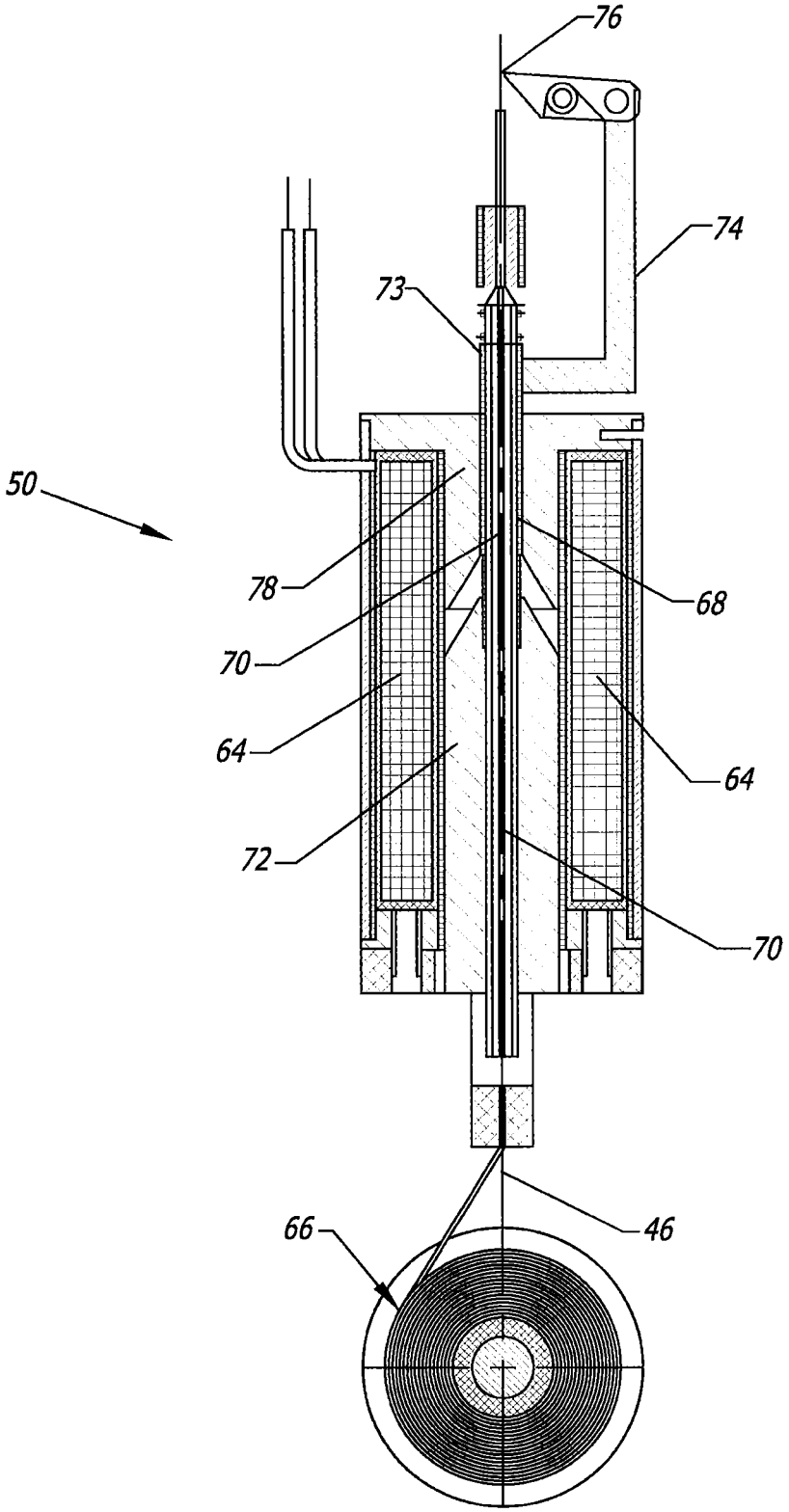
FIG. 3 is an illustration of a calibrated metal conductor delivery device.
Figure 4:
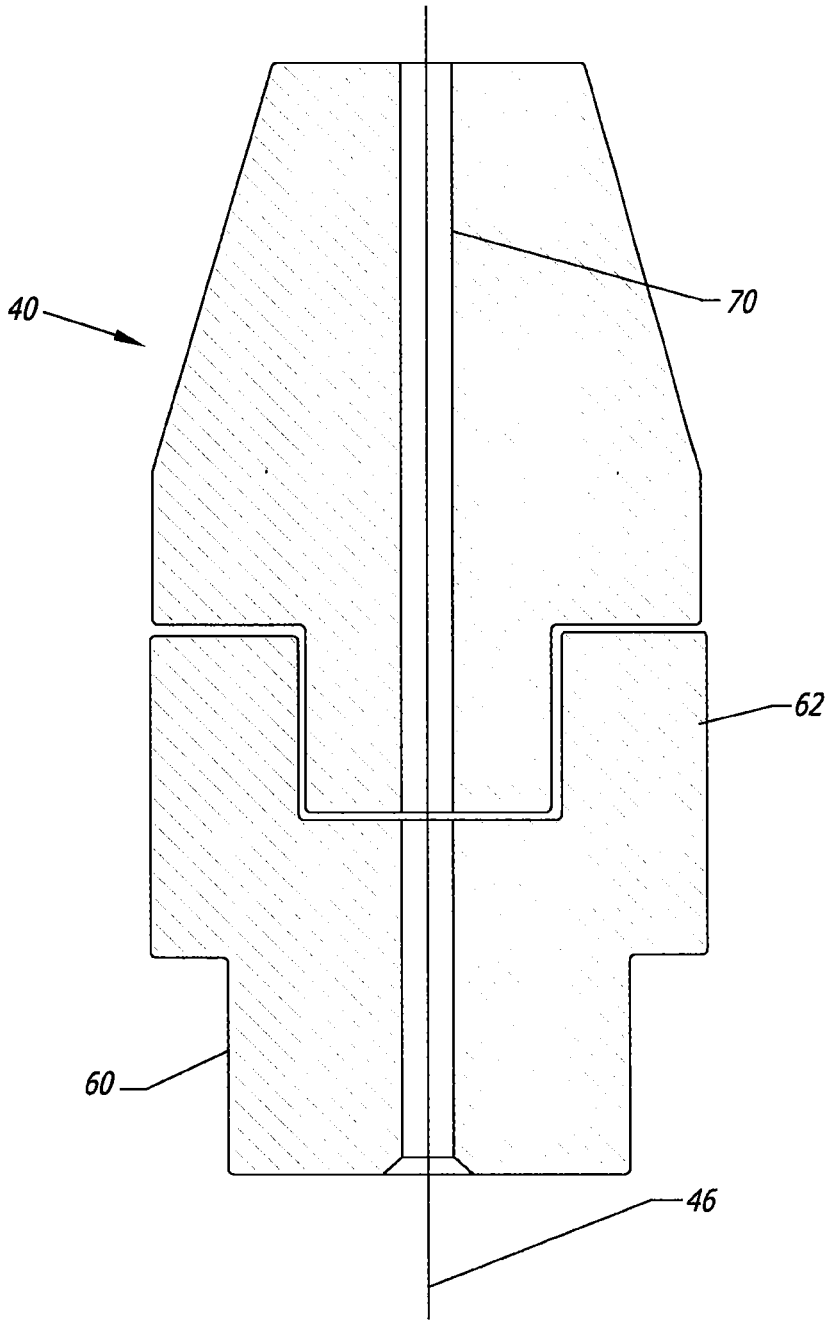
FIG. 4 is an illustration of a bottom electrode with an axial opening for delivery of the calibrated metal conductor.
Figure 5:
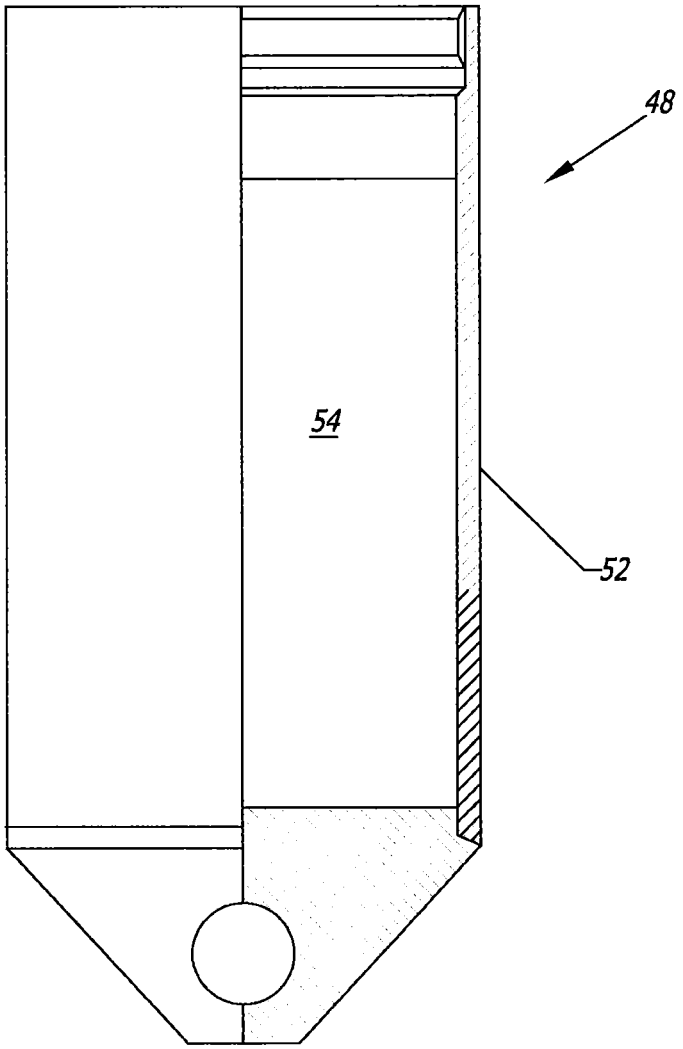
FIG. 5 is a diagram of an enclosure of the device for delivering the calibrated metal conductor containing a compensation dielectric liquid.

As illustrated in FIGS. 2-4, the delivery device 50 for delivering calibrated metal conductor 46 into the gap 56 located between electrodes 38 and 40 has a platform 60 with a flange 62 for attachment to plasma emitter 28. In accordance with FIG. 3, the following details are mounted on the platform 60 made of a dielectric material: electromagnet 64, spool 66 for storing calibrated metal conductor 46, plastic guide bushing 68 with an axial opening 70, which is pressed to bottom electrode 40. The openings in guide bushing 68 and bottom electrode 40 are adjusted accordingly for directing metal conductor 46 into the inter-electrode gap 56. The core 72 of electromagnet 64 has a frame 73 with an L-shaped push type actuator 74 having pointed edge 76. The electromagnet 64, actuator 74, and pointed edge 76 cooperate to guide the calibrated metal conductor 46 and, during the back-and-forth motion of an electric magnet plunger 78, direct the conductor 46 into the inter-electrode gap 56. The electromagnetic core 72 and the plunger 78 have axial openings 70 for transporting the metal conductor 46 from storage spool 66.

The electrical discharge occurring between electrodes 38 and 40 bridged by the calibrated metal conductor 46 leads to the explosion of metal conductor 46 and the formation of a metallic plasma burst. This creates a pressure pulse/shock wave in the inter-electrode space 56 of the plasma emitter 28 that propagates out through the well fluid 10 contained in a productive hydrocarbon deposit, the energy of which is directed to the well's productive intervals by directing stands 58 of the plasma emitter 28 (FIG. 6).

On an operator's command, plasma source 20 performs the following actions: actuation of the delivery device 50 to feed calibrated metal conductor 46 (FIGS. 2, 3); charging of power capacitor unit 34; starting contactor 36 initiating the electric discharge through a high-voltage circuit to electrodes 38 and 40 bridged by calibrated metal conductor 46; and a count of pulses from the plasma emitter is displayed on the panel of the ground control unit 16.

The control unit 16 located in mobile station 14 sends, through cable 18, voltage pulses to electromagnet 64 of the device 50 for delivering calibrated metal conductor 46 for bridging electrodes 38 and 40 of plasma emitter 28. The required number of pulses, the frequency of plasma pulses generated by plasma source 20 being moved along the well/borehole 22 and the number of plasma pulses per point/length unit of the well is usually evaluated prior to the insertion of plasma source 20 into the well 22. The anticipated treatment schedule can be preliminarily programmed using the ground control unit 16 and can then be initiated by an operator following the insertion of plasma source 20 in the well/borehole 22 to be treated.

The energy stored on capacitor unit 34 is used for generating the pressure pulse/shock wave that is initiated within the inter-electrode space 56 and propagates far beyond. First, the voltage to high-voltage transformer 30 is provided through logging/power cable 18 followed by charging capacitor unit 34. An electric signal is transmitted to electronic and relay blocks 32 through cable 18, and the blocks switch the corresponding cores of cable 18. A start signal is then transmitted to contactor 36. After the actuation of the contactor 36, a high-voltage pulse is sent from capacitor unit 34 to high-voltage electrode 38 of plasma emitter 28 through a high-voltage electric circuit. At that time, plasma emerges in the space between electrode 38 and electrode 40, and the associated spatial pressure profile emerges. The discharge registration is conducted in accordance with the signal level of a Rogovsky coil 80 installed in the electric discharge circuit 35 of capacitor unit 34.

The technical characteristics of the preferred embodiment of the inventive plasma source 20 are as follows: pulse power: 1.5-2 kJ; capacitors' charging voltage: 2.5-6 kV; primary AC voltage supplied through the cable from ground power source: 80-300 V; average plasma source work cycle duration in well: 25-35 s; maximal number of pulses without lifting the source up to the surface: 2000; plasma source length: approximately 8 feet (2.5 m); plasma source outer diameter: approximately 4 inches (10 cm) or smaller; and plasma source weight: approximately 155 pounds (70 kg) or smaller.

In another preferred embodiment (not shown), the plasma source 20 is designed in such a way so as to assure its flexibility required for movement along curved parts of a well 22. In this embodiment, components including transformer charger 30, electronic and relay blocks 32, capacitor unit 34, contactor 36, connectors 37, and plasma emitter 28 are secluded in separate metal/impact resistant plastic hermetical enclosures. Each component is then connected by means of flexible external electrical cable hermetically entering each enclosure. The connections can be secured with chains, belts, springs or similar equipment. The total number of individual enclosures depends on the required flexibility and electrical requirements of the components.

The flexible inter-enclosure cable can be secluded in a bellows hose with the ends of the bellows being hermetically attached to corresponding enclosures. Hermetic entrance of the inter-enclosure cables into enclosures may not be required in such a case, but is still desirable as protection against the accidental rupture of the bellows. The bellows can be made of metal or other material(s), including impact resistant plastic.

The components of the plasma source 20 and their parts can be connected with flexible/semi-flexible connectors 37' and placed in flexible housing 26' fabricated in the form of large bellows or can be housed by other impact-proof flexible enclosures provided with hermetic connections. Flexible bellows-like enclosures having a conical front end can be used as an enclosure for the delivery device 50. The enclosures can be fabricated from any impact-proof flexible material. Using bellows ensures the flexibility of the plasma source 20

The efficiency of the inventive process and apparatus for FOR applications is summarized in FIGS. 8 and 9. It can be immediately seen from comparing the before and after columns that the production capacity of the treated wells significantly increased following the treatment.

The plasma source 20 is preferably equipped with sensors, including temperature sensors, pressure sensors, level sensors, moisture sensors, hydrocarbon detectors and/or other sensor/detecting device(s) for providing feedback.

The inventive plasma source is applied in field conditions and does not require using chemical or biological agents. The plasma source generates oscillations in layer/reservoir/deposit/stratum/medium containing gases, liquids and/or solids at their intrinsic resonance frequencies, while the reciprocal force of the disturbed media is not capable of affecting the source.

The well/borehole plasma source is provided with the capability to store energy on the included capacitors' unit. The plasma source releases a significant amount of energy within a tenth-of-a-microsecond burst in the form of metallic plasma, following the explosion of the calibrated metal conductor. These events are accompanied by a pressure pulse/shock wave in the well fluid with the localized temperature exceeding approximately 28,000 degrees Celsius, and the shock wave peak pressure exceeding 550 MPa. The oscillations and waves induced in the nonlinear dissipative media are characterized by significant amplitudes. The low-frequency acoustic vibrations ultimately prevail, and the coefficients of absorption, reflection and refraction undergo substantial changes.

The plasma source is capable of producing wide-band, periodic, sound waves with frequencies ranging from below 1 Hz to frequencies exceeding 20 kHz. The very broad range facilitates the capture of a dominant frequency followed by the emergence of resonance oscillations in the productive deposit. Depending on the degree of attenuation and a number of other conditions, the oscillations can last for a long duration.

Another distinguishing feature of the plasma source is that the device for delivering the calibrated metal conductor comprises an electromagnet, which has an axial opening for protracting the calibrated metal conductor from the storage spool. The frame, with an L-shaped push type actuator having a tapered trailing edge, is firmly attached to the magnet's core. The actuator presses the conductor to the platform, which holds all of the details of the delivery device. The calibrated metal conductor is transported through the coaxial openings in the plastic guide bush and the bottom electrode and is then brought into contact with the top high-voltage electrode.

The device for delivering the calibrated metal conductor is housed in an enclosure attached to the plasma source with a threaded connection. The enclosure is filled with compensation liquid for preventing well fluid from entering into the delivery device and for cooling the bottom electrode. The enclosure is shaped as a cone, for example, a tapered cone, to minimize the clinging of the source in the well.

The calibrated metal conductor is transported into the inter-electrode spacing using the delivery device located in the metal enclosure. The conductor is made of a metal, an alloy, a metal-containing composite or other electrically conducting material for forming the metallic plasma and sustaining plasma chemical reactions, if desired. These reactions can include the transformations of organic compounds, catalytic processes and metal-organic reactions.

The preferable diameter of the conductor is 0.3-0.9 mm and can vary substantially, depending on the material's properties and required plasma parameters.

The discharge circuit of the capacitor's unit is provided with a Rogovsky coil for registering the current on the capacitors' storage discharge circuit and creating an electric signal for the pulse counter.

Figure 10:
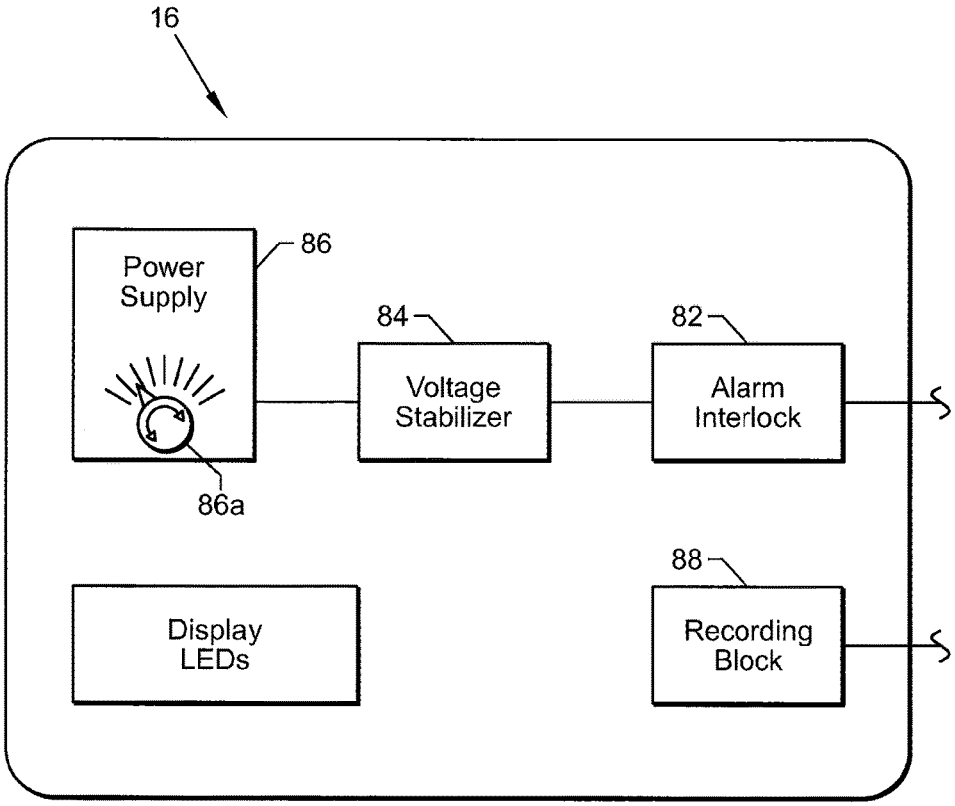
FIG. 10 is a schematic drawing of a ground control unit according to the present invention.

As schematically shown in FIG. 10, the ground control unit 16 of the inventive apparatus is provided with a discharge alarm/interlock 82. It allows the operator to control the pitch of the metal conductor 46 drawing through the opening 70 in the bottom electrode 48 for bridging the gap 56 between the two electrodes 38, 40. The alarm/interlock 82 controls the discharge level, and will shutdown the plasma source 20 should the plasma idle. The control unit 16 can be controlled with a computer, including a remote computer, cell phone or other remote device(s).

The control unit 16 of the plasma source 20 is provided with an electronic voltage stabilizer 84, a power supply 86 featuring an incremental adjustment **86*a* of the output voltage and a recording block 88** for registering well/borehole/reservoir treatment conditions.

The treatment of a well/borehole/reservoir with the inventive source can be performed using a series of pulses at a fixed location in the well. Alternatively, the following stimulation can also be utilized: a series of pulses performed at different locations in the well or periodic generation of plasma emission with the source being moved along the well. The number of pulses applied over the treatment's course, the source's position in the well/borehole and/or the speed of the source movement in the well depends on the treatment's goal.

Although several embodiments have been described in detail, for purposes of illustration, various modifications may be made without departing from the scope and spirit of the invention. Accordingly, the invention is not to be limited, except as by the appended claims.

What is claimed is:

1. A plasma source comprising:

a plasma emitter comprising a first electrode and a second electrode, the first electrode and the second electrode defining an electrode gap;

an enclosure housing attached to a distal end of the plasma emitter, the enclosure housing comprising a delivery device configured to introduce a metal conductor through an axial opening in the second electrode and into the electrode gap; and a device housing attached to a proximal end of the plasma emitter, the device housing comprising:

a high voltage transformer;

a capacitor unit electrically coupled to the high voltage transformer; and a contactor electrically coupled to the capacitor unit and the first electrode, wherein:

the delivery device comprises an electromagnet configured to deliver the metal conductor through the axial opening in the second electrode and into the electrode gap;

the delivery device comprises a platform comprising a dielectric material;

the platform contacts the second electrode; and the electromagnet is coupled to the platform.

2. The plasma source of claim 1, wherein:

the delivery device comprises a push type actuator configured to cooperate with the electromagnet to guide the metal conductor into the electrode gap.

3. The plasma source of claim 2, wherein:

the push type actuator comprises an L-shaped push type actuator.

4. The plasma source of claim 1, wherein:

the plasma emitter comprises a pulse counter; and the capacitor unit comprises a discharge circuit and a Rogovsky coil configured to register a current of the discharge circuit and create an electrical signal for the pulse counter of the plasma emitter.

5. The plasma source of claim 1, wherein at least one of:

the capacitor unit comprises a capacitor, and the capacitor comprises a charging voltage of 2.5 kilovolts-6 kilovolts; or the plasma source comprises a pulse power of 1.5 kilojoules-2 kilojoules.

6. The plasma source of claim 1, wherein:

the device housing comprises a flexible housing comprising multiple bellows that contain the high voltage transformer, the capacitor unit, and the contactor.

7. The plasma source of claim 1, further comprising:

an interlock configured to deactivate the plasma source when plasma created at the plasma emitter idles.

8. The plasma source of claim 1, wherein at least one of:

the first electrode comprises a refractory metal or a refractory alloy; or the metal conductor comprises a homogenous electroconductive material.

9. The plasma source of claim 1, wherein:

the first electrode is electrically insulated from the plasma emitter; and the second electrode is electrically grounded to the plasma emitter.

10. The plasma source of claim 1, wherein:

the enclosure housing is sealed and contains a dielectric compensation liquid.

11. A system comprising:

a plasma source comprising:

a plasma emitter having a first electrode and a second electrode, the first electrode and the second electrode defining an electrode gap;

an enclosure housing attached to a distal end of the plasma emitter, the enclosure housing comprising a delivery device configured to introduce a metal conductor through an axial opening in the second electrode and into the electrode gap; and a device housing attached to a proximal end of the plasma emitter, the device housing comprising:

a high voltage transformer;

a capacitor unit electrically coupled to the high voltage transformer; and a contactor electrically coupled to the capacitor unit and the first electrode;

a support cable comprising a fixed end and a remote end coupled to the plasma source; and a ground control unit coupled to the fixed end of the support cable, wherein:

the delivery device comprises an electromagnet configured to deliver the metal conductor through the axial opening in the second electrode and into the electrode gap;

the delivery device comprises a platform comprising a dielectric material;

the platform contacts the second electrode; and the electromagnet is coupled to the platform.

12. The system of claim 11, further comprising:

an interlock configured to deactivate the plasma source when plasma created at the plasma emitter idles, wherein:

the delivery device comprises a push type actuator configured to cooperate with the electromagnet to guide the metal conductor into the electrode gap;

the plasma emitter comprises a pulse counter; and the capacitor unit comprises a discharge circuit and a Rogovsky coil configured to register a current of the discharge circuit and create an electrical signal for the pulse counter of the plasma emitter.

13. The system of claim 11, wherein:

the plasma emitter comprises multiple metal stands disposed adjacent to the electrode gap.

14. The system of claim 11, wherein at least one of:

the capacitor unit comprises a capacitor, and the capacitor comprises a charging voltage of 2.5 kilovolts-6 kilovolts; or the plasma source comprises a pulse power of 1.5 kilojoules-2 kilojoules.

15. A method comprising:

providing a plasma source, the plasma source comprising:

a plasma emitter having a first electrode and a second electrode, the first electrode and the second electrode defining an electrode gap;

an enclosure housing attached to a distal end of the plasma emitter, the enclosure housing comprising a delivery device configured to introduce a metal conductor through an axial opening in the second electrode and into the electrode gap; and a device housing attached to a proximal end of the plasma emitter, the device housing comprising:

a high voltage transformer;

a capacitor unit electrically coupled to the high voltage transformer; and a contactor electrically coupled to the capacitor unit and the first electrode;

positioning the plasma source in a fluid medium;

delivering the metal conductor through the axial opening in the second electrode and into the electrode gap with an electromagnet of the delivery device;

creating a metallic plasma in the electrode gap;

generating a shockwave in the metallic plasma in the electrode gap; and transmitting the shockwave from the metallic plasma into the fluid medium to create oscillations in the fluid medium, wherein:

the delivery device comprises a platform comprising a dielectric material;

the platform contacts the second electrode; and the electromagnet is coupled to the platform.

16. The method of claim 15, wherein:

delivering the metal conductor into the electrode gap with the electromagnet of the delivery device comprises:

guiding the metal conductor into the electrode gap with the electromagnet and a push type actuator of the delivery device.

17. The method of claim 15, further comprising:

registering a current of a discharge circuit of the capacitor unit with a Rogovsky coil; and creating an electrical signal for a pulse counter of the plasma emitter with the Rogovsky coil.

18. The method of claim 15, further comprising:

deactivating the plasma source with an interlock when the metallic plasma created at the plasma emitter idles.

19. The method of claim 15, further comprising:

charging a capacitor of the capacitor unit to a voltage of 2.5 kilovolts-6 kilovolts.

20. A plasma source comprising:

a plasma emitter comprising a first electrode and a second electrode, the first electrode and the second electrode defining an electrode gap;

an enclosure housing attached to a distal end of the plasma emitter, the enclosure housing comprising a delivery device configured to introduce a metal conductor through an axial opening in the second electrode and into the electrode gap; and a device housing attached to a proximal end of the plasma emitter, the device housing comprising:

a high voltage transformer;

a capacitor unit electrically coupled to the high voltage transformer; and a contactor electrically coupled to the capacitor unit and the first electrode, wherein:

the delivery device comprises an electromagnet configured to deliver the metal conductor through the axial opening in the second electrode and into the electrode gap;

the delivery device comprises a platform comprising a dielectric material;

the platform contacts the second electrode;

the platform further comprises a flange; and the flange attaches the platform to the second electrode.

* * * * *